US011506431B2

(12) United States Patent
Maeda et al.

(10) Patent No.: US 11,506,431 B2
(45) Date of Patent: Nov. 22, 2022

(54) REFRIGERATION CYCLE APPARATUS

(71) Applicant: Mitsubishi Electric Corporation, Tokyo (JP)

(72) Inventors: Tsuyoshi Maeda, Tokyo (JP); Akira Ishibashi, Tokyo (JP); Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 163 days.

(21) Appl. No.: 17/040,820

(22) PCT Filed: May 17, 2018

(86) PCT No.: PCT/JP2018/019042
§ 371 (c)(1),
(2) Date: Sep. 23, 2020

(87) PCT Pub. No.: WO2019/220585
PCT Pub. Date: Nov. 21, 2019

(65) Prior Publication Data
US 2021/0003325 A1 Jan. 7, 2021

(51) Int. Cl.
*F25B 1/00* (2006.01)
*F25B 41/40* (2021.01)
(Continued)

(52) U.S. Cl.
CPC ..... *F25B 41/40* (2021.01); *F25B 39/00* (2013.01); *F25B 41/00* (2013.01); *F25B 39/02* (2013.01);
(Continued)

(58) Field of Classification Search
CPC ..... F25B 41/40; F25B 39/00; F25B 39/02; F25B 39/04; F25B 41/00; F25B 2400/12; F25B 2500/01; F25B 2339/02
See application file for complete search history.

(56) References Cited

U.S. PATENT DOCUMENTS 5,839,295 A * 11/1998 Lehmann ..... F25B 39/022 62/295
9,932,817 B1 4/2018 Kusmer et al.
(Continued)

FOREIGN PATENT DOCUMENTS

EP 2679921 A2 1/2014
JP S63-019420 U 2/1988
(Continued)

OTHER PUBLICATIONS

Office Action dated Mar. 25, 2021 issued in corresponding European patent application No. 18919177.8.
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A refrigeration cycle apparatus includes a refrigerant circuit including a compressor, a condenser, a pressure reducing device, and an evaporator connected by a refrigerant pipe. A refrigerant including a refrigerant having flammability is used as refrigerant circulating in the refrigerant circuit. The evaporator and the pressure reducing device are accommodated in a unit. The evaporator is disposed in the unit in such a manner that a linear distance between a refrigerant inlet of the evaporator and a refrigerant outlet of the pressure reducing device is shorter than a linear distance between a refrigerant outlet of the evaporator and the refrigerant outlet of the pressure reducing device.

11 Claims, 13 Drawing Sheets

(51) Int. Cl.

| | |
|---|---|
| ***F25B 39/00*** | (2006.01) |
| ***F25B 41/00*** | (2021.01) |
| *F25B 39/02* | (2006.01) |
| *F25B 39/04* | (2006.01) |

(52) U.S. Cl.
CPC ..... *F25B 39/04* (2013.01); *F25B 2400/12* (2013.01); *F25B 2500/01* (2013.01)

(56) References Cited

U.S. PATENT DOCUMENTS

| | | | | |
|---|---|---|---|---|
| 2002/0020183 | A1 | 2/2002 | Hayashi | |
| 2005/0050914 | A1 | 3/2005 | Lee et al. | |
| 2006/0042274 | A1* | 3/2006 | Manole | F28F 13/18 62/77 |
| 2014/0338876 | A1* | 11/2014 | Hokazono | F28F 1/32 165/181 |
| 2015/0007605 | A1 | 1/2015 | Masui et al. | |
| 2018/0135893 | A1 | 5/2018 | Miyoshi et al. | |
| 2018/0299168 | A1* | 10/2018 | Kaneo | F25B 39/04 |
| 2019/0032973 | A1* | 1/2019 | Tanaka | F25B 1/005 |

FOREIGN PATENT DOCUMENTS

| | | | |
|---|---|---|---|
| JP | H11-230626 | A | 8/1999 |
| JP | 2001-227822 | A | 8/2001 |
| JP | 2001-241784 | A | 9/2001 |
| JP | 2001-289534 | A | 10/2001 |
| JP | 2010-121844 | A | 6/2010 |
| JP | 2013-164233 | A | 8/2013 |
| JP | 2014-142138 | A | 8/2014 |
| WO | 2017/038376 | A1 | 3/2017 |

OTHER PUBLICATIONS

Office Action dated Aug. 4, 2021 issued in corresponding CN patent application No. 201880092858.1 (and English translation).
Extended European Search Report dated Sep. 9, 2021 issued in corresponding European patent application No. 21179119.9.
Office Action dated Jun. 22, 2021 issued in corresponding JP patent application No. 2020-518896 (and English translation).
International Search Report of the International Searching Authority dated Jul. 31, 2018 for the corresponding international application No. PCT/JP2018/019042 (and English translation).

* cited by examiner

REFRIGERATION CYCLE APPARATUS

CROSS REFERENCE TO RELATED APPLICATION

This application is a U.S. national stage application of International Application No. PCT/JP2018/019042 filed on May 17, 2018, the contents of which are incorporated herein by reference.

TECHNICAL FIELD

The present disclosure relates to a refrigeration cycle apparatus that includes a refrigerant circuit including a compressor, a condenser, a pressure reducing device, and an evaporator connected by a refrigerant pipe.

BACKGROUND ART

Air-conditioning apparatuses that include an outdoor unit including a heat exchanger, a fan, a compressor, and a gas-liquid separator have been proposed in the related art (for example, see Patent Literature 1). In the air-conditioning apparatus described in Patent Literature 1, the inside of an outdoor unit is partitioned into two spaces with a partition wall. A heat exchanger and a fan are disposed in one space inside the outdoor unit. A compressor, a gas-liquid separator, and other components are disposed in the other space inside the outdoor unit.

CITATION LIST

Patent Literature

Patent Literature 1: Japanese Unexamined Patent Application Publication No. 2014-142138

SUMMARY OF INVENTION

Technical Problem

Although It is required that refrigerant to be used in refrigeration cycle apparatuses be switched to a refrigerant having a low global warming potential (GWP), many refrigerants of such a type are flammable. Thus, measures against refrigerant leakage such as reducing the filling amount of refrigerant are required. However, if the filling amount of refrigerant is reduced, desired operating efficiency cannot be satisfied. That is, there has been a problem of the difficulty of making reducing the filling amount of refrigerant and satisfying a desired coefficient of performance (COP) compatible with each other.

The present disclosure is made to solve such a problem and provides a refrigeration cycle apparatus capable of satisfying a desired COP with a reduced filling amount of a refrigerant including a refrigerant having flammability.

Solution to Problem

A refrigeration cycle apparatus according to an embodiment of the present disclosure includes a refrigerant circuit including a compressor, a condenser, a pressure reducing device, and an evaporator connected by a refrigerant pipe. A refrigerant including a refrigerant having flammability is used as refrigerant circulating in the refrigerant circuit. The evaporator and the pressure reducing device are accommodated in a unit. The evaporator is disposed in the unit in such a manner that a linear distance between a refrigerant inlet of the evaporator and a refrigerant outlet of the pressure reducing device is shorter than a linear distance between a refrigerant outlet of the evaporator and the refrigerant outlet of the pressure reducing device.

Advantageous Effects of Invention

In an embodiment of the present disclosure, the evaporator is disposed in such a manner that the linear distance between the refrigerant inlet of the evaporator and the refrigerant outlet of the pressure reducing device is shorter than the linear distance between the refrigerant outlet of the evaporator and the refrigerant outlet of the pressure reducing device. Thus, it is possible to shorten the length of the refrigerant pipe between the refrigerant inlet of the evaporator and the refrigerant outlet of the pressure reducing device, and it is possible to satisfy a desired COP with a reduced filling amount of a refrigerant including a refrigerant having flammability.

DESCRIPTION OF EMBODIMENTS

Figure 1:
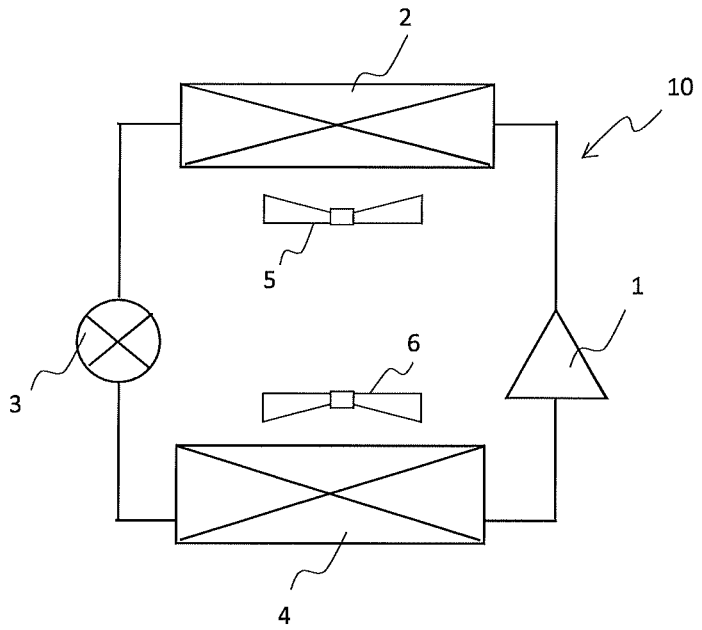
FIG. 1 is a schematic diagram illustrating an example of a configuration of a refrigerant circuit of a refrigeration cycle apparatus according to Embodiment 1 of the present disclosure.

Embodiments of the present disclosure are described below with reference to the drawings as appropriate. The size relationships of the components in the drawings below may differ from those of actual ones. In the drawings below, the components having the same reference signs are the same or corresponding components, and this applies to the whole description. In addition, the forms of the components in the whole description are merely examples, and the forms of the components are not limited to those in the description.

In the embodiments below, although an air-conditioning apparatus is described as an example of a refrigeration cycle apparatus, the present disclosure is not limited to the example. For example, the refrigeration cycle apparatus is also applicable to other apparatuses including a heat exchanger, such as refrigerating apparatuses and water heaters.

Embodiment 1

FIG. 1 is a schematic diagram illustrating an example of a configuration of a refrigerant circuit of a refrigeration cycle apparatus according to Embodiment 1 of the present disclosure.

As illustrated in FIG. 1, the refrigeration cycle apparatus includes a refrigerant circuit 10. The refrigerant circuit 10 includes a compressor 1, a condenser 2, a pressure reducing device 3, and an evaporator 4. The compressor 1, the condenser 2, the pressure reducing device 3, and the evaporator 4 are connected by a refrigerant pipe in this order to form an annular shape, and refrigerant circulates in the refrigerant circuit 10.

In the refrigeration cycle apparatus, a refrigerant including a refrigerant having flammability is used as refrigerant circulating in the refrigerant circuit 10. Examples of such a refrigerant having flammability include a hydrocarbon (HC)-based natural refrigerant having flammability, such as R290 and R1270, and a mixed refrigerant containing such a refrigerant as a main constituent.

The compressor 1 compresses and discharges refrigerant. The compressor 1 can be composed of, for example, a rotary compressor, a scroll compressor, a screw compressor, or a reciprocating compressor. The condenser 2 exchanges heat between refrigerant and air, which is an example of heat exchange fluids. The condenser 2 can be composed of a fin-and-tube heat exchanger. The pressure reducing device 3 decompresses and expands the refrigerant flowing in the refrigerant circuit 10. The pressure reducing device 3 is composed of, for example, an electronic expansion valve or a thermosensitive expansion valve. The evaporator 4 exchanges heat between refrigerant and air, which is an example of heat exchange fluids. The evaporator 4 can be composed of a fin-and-tube heat exchanger.

The condenser 2 is provided with a condenser side fan 5. The condenser side fan 5 supplies air, which is an example of heat exchange fluids, to the condenser 2. The evaporator 4 is provided with an evaporator side fan 6. The evaporator side fan 6 supplies air, which is an example of heat exchange fluids, to the evaporator 4. The condenser side fan 5 and the evaporator side fan 6 can be each composed of, for example, a propeller fan including a plurality of vanes.

Figure 2:
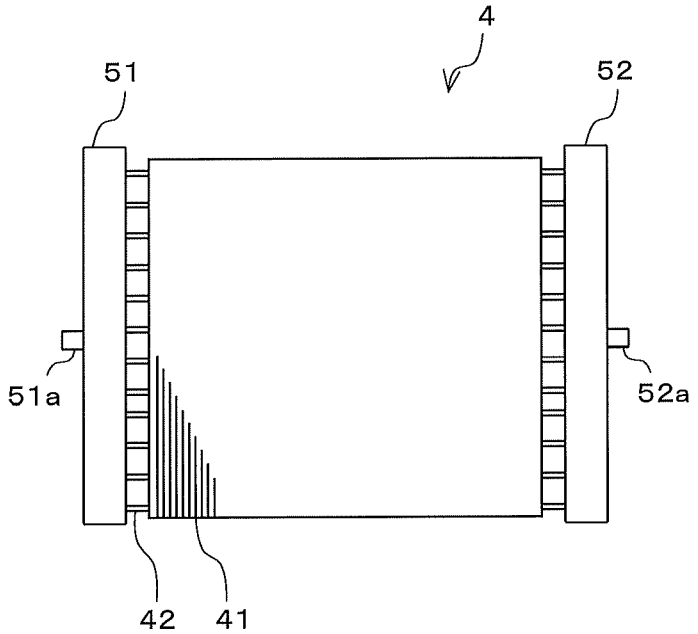
FIG. 2 is a side view illustrating an evaporator of the refrigeration cycle apparatus according to Embodiment 1 of the present disclosure.

FIG. 2 is a side view illustrating the evaporator of the refrigeration cycle apparatus according to Embodiment 1 of the present disclosure.

As illustrated in FIG. 2, the evaporator 4 includes a plurality of fins 41 and a plurality of heat-transfer tubes 42. The fins 41 are each flat-plate shaped and are disposed in parallel to each other with a distance between the fins 41. Air flows between the fins 41. The heat-transfer tubes 42 are disposed in parallel to each other and are attached to the fins 41. The heat-transfer tubes 42 each contain a refrigerant passage. The heat-transfer tubes 42 are flat tubes whose sections orthogonal to the axis of the refrigerant passage have a flat shape. The heat-transfer tubes 42 are disposed in such a manner that the major axis of each section having a flat shape is parallel to a direction in which air flows.

One end portion of each of the heat-transfer tubes 42 is connected to a first header 51, and the other end portion is connected to a second header 52. The first header 51 diverts, into each of the heat-transfer tubes 42, the refrigerant flowing into the first header 51 from an inlet 51*a*. The second header 52 collects the refrigerant flowing into the second header 52 from each of the heat-transfer tubes 42, and the refrigerant flows out from an outlet 52*a*.

Next, the operation of the refrigeration cycle apparatus with a refrigerant flow is described. Gas refrigerant having a high temperature and a high pressure is discharged from the compressor 1 by driving the compressor 1. The gas refrigerant having a high temperature and a high pressure discharged from the compressor 1 flows into the condenser 2. The condenser 2 exchanges heat between air and the gas refrigerant having a high temperature and a high pressure that has flowed into the condenser 2. Then, the gas refrigerant having a high temperature and a high pressure condenses into liquid refrigerant having a high pressure.

The pressure reducing device 3 changes the liquid refrigerant having a high pressure sent from the condenser 2 into liquid refrigerant having a low pressure, and then the liquid refrigerant having a low pressure flows into the evaporator 4. The evaporator 4 exchanges heat between air and the liquid refrigerant that has flowed into the evaporator 4. Then, the liquid refrigerant evaporates into gas refrigerant having a low pressure. The gas refrigerant having a low pressure sent from the evaporator 4 flows into the compressor 1 and is compressed into gas refrigerant having a high temperature and a high pressure. Then, the gas refrigerant having a high temperature and a high pressure is discharged from the compressor 1 again. Hereafter, this cycle is repeated.

Figure 3:
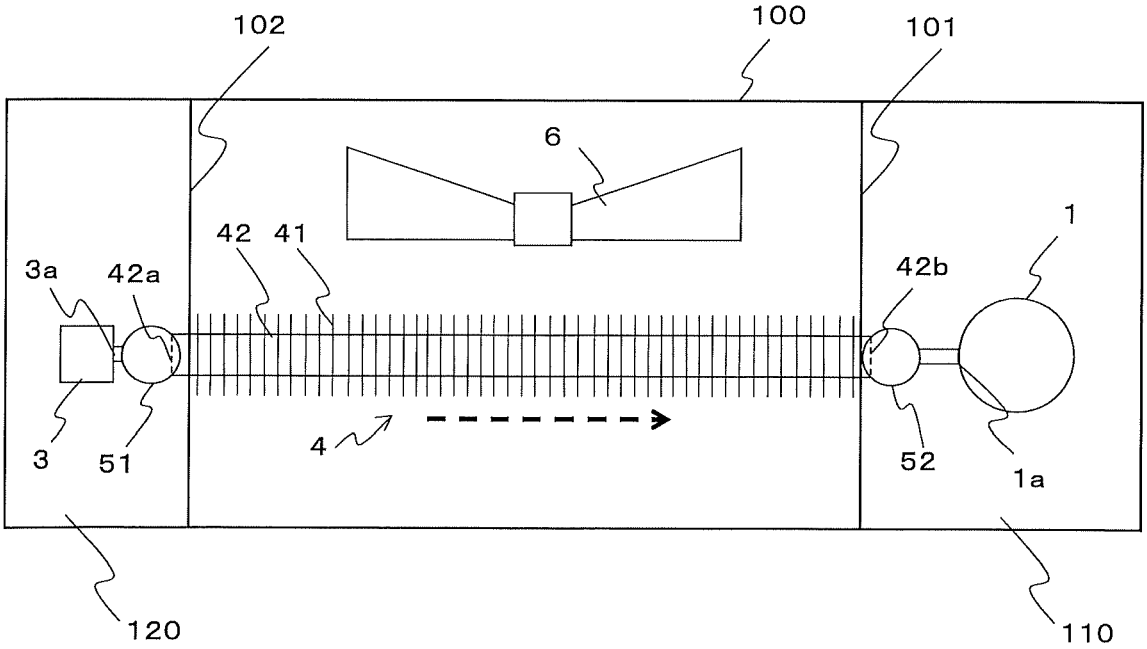
FIG. 3 is a schematic diagram illustrating a disposition in a unit of the refrigeration cycle apparatus according to Embodiment 1 of the present disclosure.
Figure 4:
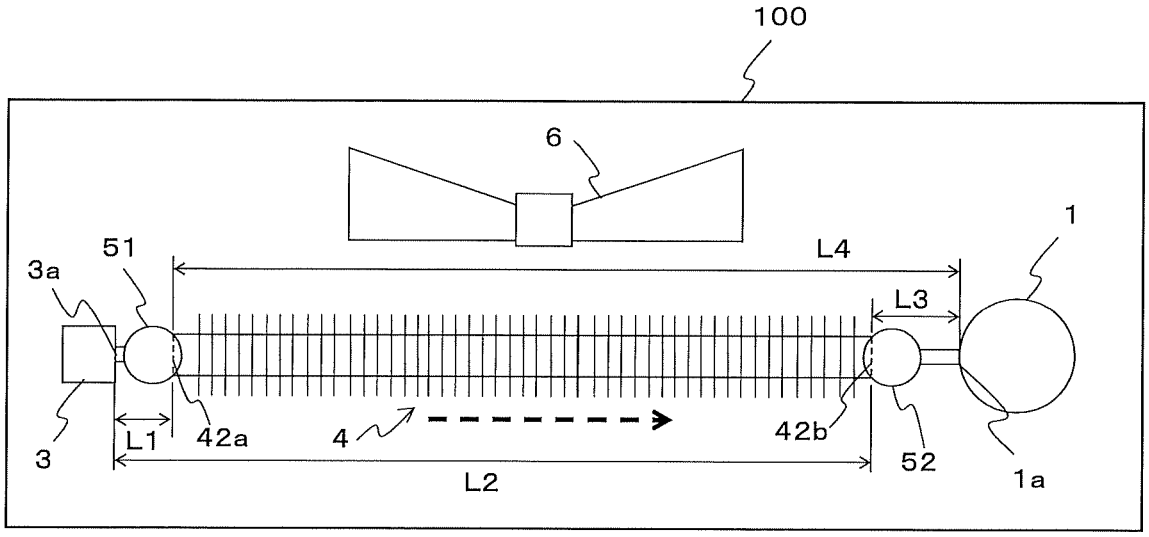
FIG. 4 is a schematic diagram illustrating a disposition in the unit of the refrigeration cycle apparatus according to Embodiment 1 of the present disclosure.

FIGS. 3 and 4 are schematic diagrams each illustrating a disposition in a unit of the refrigeration cycle apparatus according to Embodiment 1 of the present disclosure. FIGS. 3 and 4 are top views of the unit each illustrating the disposition of each component. In FIGS. 3 and 4, a refrigerant flow is represented by a dashed arrow. In FIG. 4, some components are not illustrated.

As illustrated in FIG. 3, the compressor 1, the pressure reducing device 3, and the evaporator 4 are accommodated in a unit 100. The unit 100 is, for example, an outdoor unit in an air-conditioning apparatus. In addition, airflow paths through which air flows are formed in the unit 100, and the air sent from the evaporator side fan 6 passes through the evaporator 4. In addition, the unit 100 includes a first compartment 110, which is partitioned off by a partition wall 101. The compressor 1 and the second header 52 are disposed in the first compartment 110. In addition to the first compartment 110, the unit 100 includes a second compartment 120, which is partitioned off by a partition wall 102. The pressure reducing device 3 and the first header 51 are disposed in the second compartment 120. The evaporator 4 is disposed in a space between the first compartment 110 and the second compartment 120 in the unit 100.

As illustrated in FIG. 4, the evaporator 4 is disposed in the unit 100 in such a manner that a linear distance L1 between a refrigerant inlet of the evaporator 4 and a refrigerant outlet 3*a* of the pressure reducing device 3 is shorter than a linear distance L2 between a refrigerant outlet of the evaporator 4 and the refrigerant outlet of the pressure reducing device 3. The refrigerant inlet of the evaporator 4 is one of end portions 42*a* of refrigerant inlets of the heat-transfer tubes 42. The refrigerant outlet of the evaporator 4 is one of end portions 42*b* of refrigerant outlets of the heat-transfer tubes 42. Examples of the linear distance L1 and the linear distance L2 are described with reference to FIG. 4.

Figure 5:
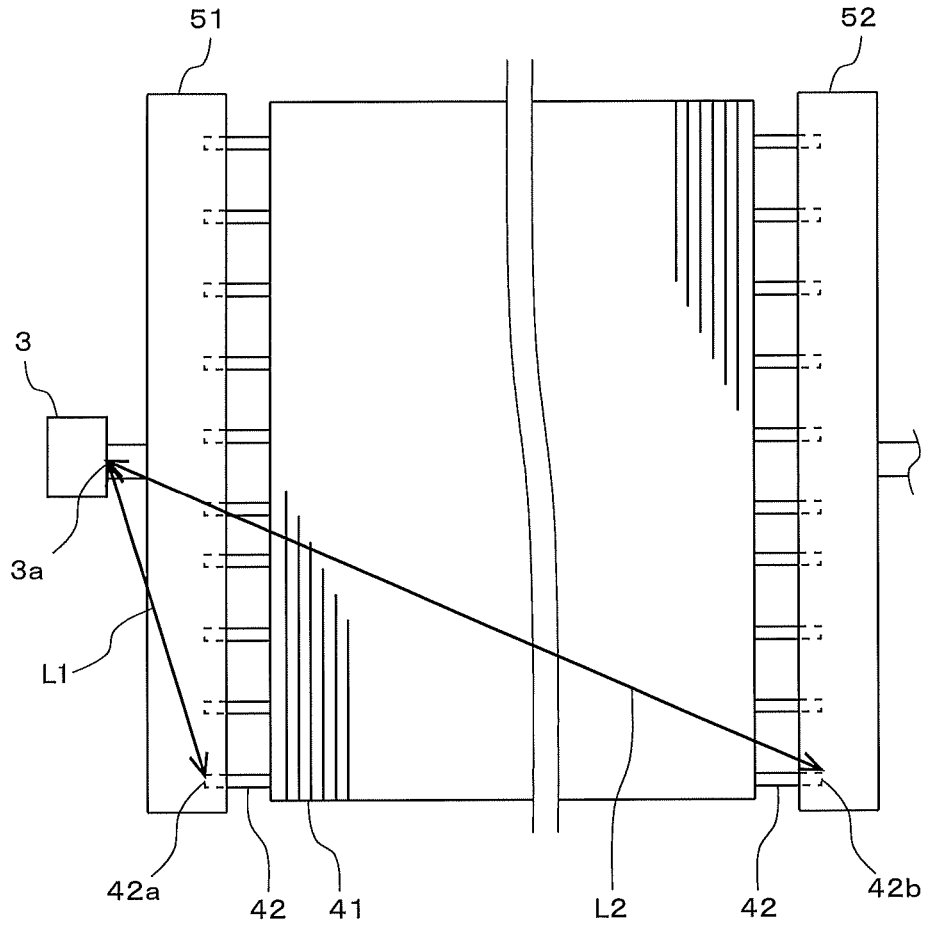
FIG. 5 is a side view illustrating the evaporator of the refrigeration cycle apparatus according to Embodiment 1 of the present disclosure.

FIG. 5 is a side view illustrating the evaporator of the refrigeration cycle apparatus according to Embodiment 1 of the present disclosure.

As illustrated in FIG. 5, the linear distance L1 is the linear distance between the refrigerant outlet 3*a* of the pressure reducing device 3 and the end portion 42*a* farthest from the refrigerant outlet 3*a* of the pressure reducing device 3 among the end portions 42*a* of the refrigerant inlets of the heat-transfer tubes 42. The linear distance L2 is the linear distance between the refrigerant outlet 3*a* of the pressure reducing device 3 and the end portion 42*b* farthest from the refrigerant outlet 3*a* of the pressure reducing device 3 among the end portions 42*b* of the refrigerant outlets of the heat-transfer tubes 42.

The linear distance L1 and the linear distance L2 are not limited to these illustrated in FIG. 5. For example, the linear distance L1 may be the linear distance between the refrigerant outlet 3*a* of the pressure reducing device 3 and the end portion 42*a* closest to the refrigerant outlet 3*a* of the pressure reducing device 3 among the end portions 42*a* of the refrigerant inlets of the heat-transfer tubes 42. The linear distance L2 may be the linear distance between the refrigerant outlet 3*a* of the pressure reducing device 3 and the end portion 42*b* closest to the refrigerant outlet 3*a* of the pressure reducing device 3 among the end portions 42*b* of the refrigerant outlets of the heat-transfer tubes 42.

FIG. 4 is referred to again. The evaporator 4 is disposed in the unit 100 in such a manner that a linear distance L3 between the refrigerant outlet of the evaporator 4 and a refrigerant inlet 1*a* of the compressor 1 is shorter than a linear distance L4 between the refrigerant inlet of the evaporator 4 and the refrigerant inlet 1*a* of the compressor 1. The refrigerant inlet of the evaporator 4 is one of the end portions 42*a* of the refrigerant inlets of the heat-transfer tubes 42. The refrigerant outlet of the evaporator 4 is one of the end portions 42*b* of the refrigerant outlets of the heat-transfer tubes 42. Examples of the linear distance L3 and the linear distance L4 are described with reference to FIG. 6.

Figure 6:
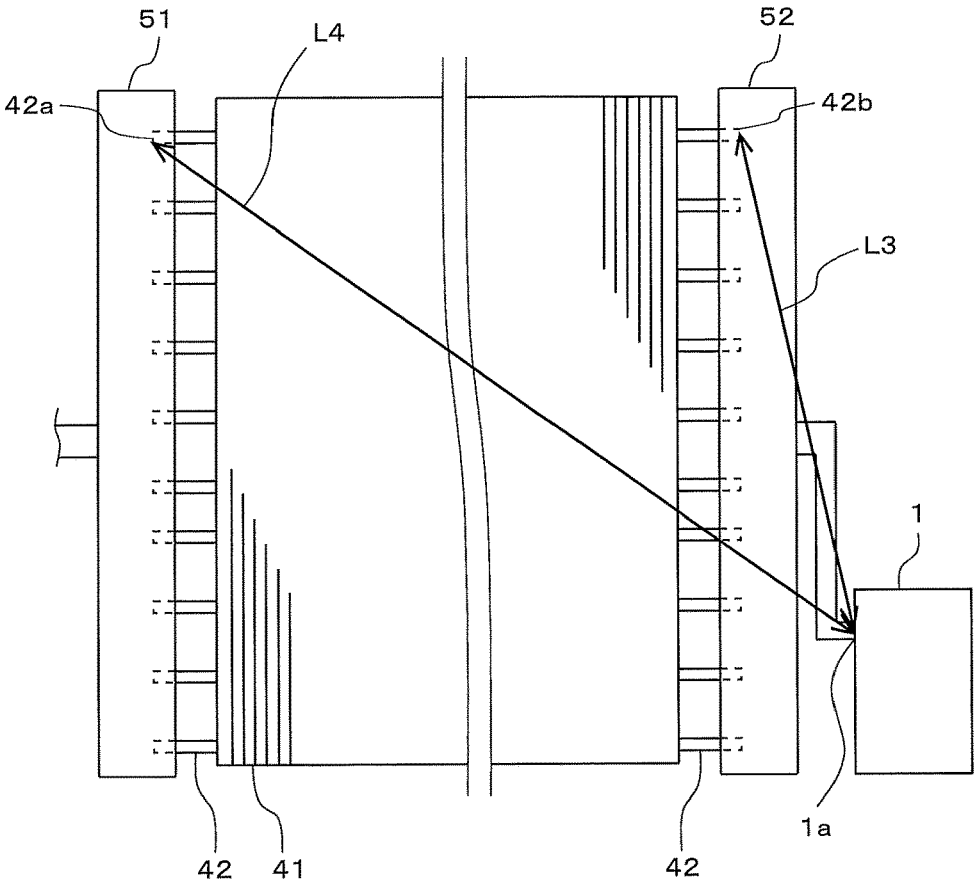
FIG. 6 is a side view illustrating the evaporator of the refrigeration cycle apparatus according to Embodiment 1 of the present disclosure.

FIG. 6 is a side view illustrating the evaporator of the refrigeration cycle apparatus according to Embodiment 1 of the present disclosure.

As illustrated in FIG. 6, the linear distance L3 is the linear distance between the refrigerant inlet 1*a* of the compressor 1 and the end portion 42*b* farthest from the refrigerant inlet 1*a* of the compressor 1 among the end portions 42*b* of the refrigerant outlets of the heat-transfer tubes 42. The linear distance L4 is the linear distance between the refrigerant inlet 1*a* of the compressor 1 and the end portion 42*a* farthest from the refrigerant inlet 1*a* of the compressor 1 among the end portions 42*a* of the refrigerant inlets of the heat-transfer tubes 42.

The linear distance L3 and the linear distance L4 are not limited to these illustrated in FIG. 6. For example, the linear distance L3 may be the linear distance between the refrigerant inlet 1*a* of the compressor 1 and the end portion 42*b* closest to the refrigerant inlet 1*a* of the compressor 1 among the end portions 42*b* of the refrigerant outlets of the heat-transfer tubes 42. The linear distance L4 may be the linear distance between the refrigerant inlet 1*a* of the compressor 1 and the end portion 42*a* closest to the refrigerant inlet 1*a* of the compressor 1 among the end portions 42*a* of the refrigerant inlets of the heat-transfer tubes 42.

As described above, in Embodiment 1, a refrigerant including a refrigerant having flammability is used as refrigerant circulating in the refrigerant circuit 10. The evaporator 4 and the pressure reducing device 3 are accommodated in the unit 100. The evaporator 4 is disposed in the unit 100 in such a manner that the linear distance L1 between the refrigerant inlet of the evaporator 4 and the refrigerant outlet 3*a* of the pressure reducing device 3 is shorter than the linear distance L2 between the refrigerant outlet of the evaporator 4 and the refrigerant outlet 3*a* of the pressure reducing device 3.

Thus, the length of the refrigerant pipe between the refrigerant inlet of the evaporator 4 and the refrigerant outlet 3*a* of the pressure reducing device 3 can be shorter than the length in the case in which the linear distance L1 is longer than or equal to the linear distance L2. Accordingly, the amount of the liquid refrigerant in the refrigerant pipe can be smaller than the amount in the case in which the linear distance L1 is longer than or equal to the linear distance L2. As a result, it is possible to satisfy a desired COP with a reduced filling amount of a refrigerant including a refrigerant having flammability. In addition, the pressure loss of the liquid refrigerant can be reduced by shortening the length of the refrigerant pipe between the refrigerant inlet of the evaporator and the refrigerant outlet 3*a* of the pressure reducing device 3.

In addition, in Embodiment 1, the compressor 1 is accommodated in the unit 100. The evaporator is disposed in the unit 100 in such a manner that the linear distance L3 between the refrigerant outlet of the evaporator 4 and the refrigerant inlet 1*a* of the compressor 1 is shorter than the linear distance L4 between the refrigerant inlet of the evaporator 4 and the refrigerant inlet 1*a* of the compressor 1.

Thus, the length of the refrigerant pipe between the refrigerant outlet of the evaporator 4 and the refrigerant inlet 1*a* of the compressor 1 can be shorter than the length in the case in which the linear distance L3 is longer than or equal to the linear distance L4. Accordingly, the amount of the gas refrigerant in the refrigerant pipe can be smaller than the amount in the case in which the linear distance L3 is longer than or equal to the linear distance L4. As a result, it is possible to satisfy a desired COP with a reduced filling amount of a refrigerant including a refrigerant having flammability. In addition, the pressure loss of the gas refrigerant can be reduced by shortening the length of the refrigerant pipe between the refrigerant inlet of the evaporator and the refrigerant outlet 3*a* of the pressure reducing device 3.

Embodiment 2

A configuration of a refrigeration cycle apparatus according to Embodiment 2 is described below with the focus on the differences between Embodiment 1 above and Embodiment 2. The same parts as those in Embodiment 1 above have the same reference signs and are not described.

Figure 7:
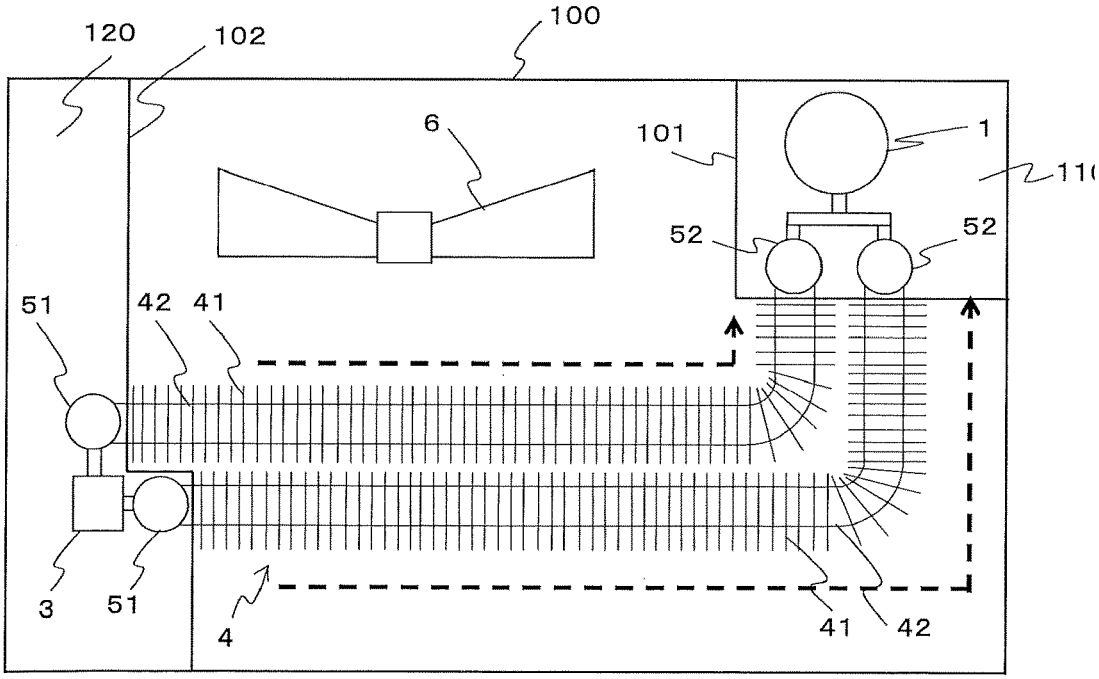
FIG. 7 is a schematic diagram illustrating a disposition in a unit of a refrigeration cycle apparatus according to Embodiment 2 of the present disclosure.

FIG. 7 is a schematic diagram illustrating a disposition in a unit of the refrigeration cycle apparatus according to Embodiment 2 of the present disclosure. FIG. 7 is a top view of the unit illustrating the disposition of each component. In FIG. 7, a refrigerant flow is represented by a dashed arrow.

As illustrated in FIG. 7, in the evaporator 4, the heat-transfer tubes 42 are disposed in two rows across a direction in which air flows. The heat-transfer tubes 42 disposed in two rows are disposed to curve to have an L shape in a top view to extend along sides of the unit 100.

Hereinafter, the heat-transfer tubes 42 disposed at positions away from the evaporator side fan 6 are referred to as the heat-transfer tubes 42 in the first row, and the heat-transfer tubes 42 disposed at positions close to the evaporator side fan 6 are referred to as the heat-transfer tubes 42 in the second row. Although FIG. 7 illustrates the heat-transfer tubes 42 disposed in two rows, the disposition is not limited to the illustration. The heat-transfer tubes 42 may be disposed in three or more rows.

The first headers 51 are disposed on the respective rows of the heat-transfer tubes 42. Each of the first headers 51 is connected to the pressure reducing device 3 by a refrigerant pipe. The second headers 52 are disposed on the respective rows of the heat-transfer tubes 42. Each of the second headers 52 is connected to the compressor 1 by a refrigerant pipe. The refrigerant that has flowed out from the pressure reducing device 3 flows into the two first headers 51. The refrigerant that has flowed out from the two second headers 52 flows into the compressor 1. That is, the evaporator 4 is a parallel flow evaporator in which the refrigerant that has flowed into the heat-transfer tubes 42 in the first row and the refrigerant that has flowed into the heat-transfer tubes 42 in the second row flow in parallel to each other.

The compressor 1 and the two second headers 52 are disposed in the first compartment 110. The pressure reducing device 3 and the two first headers 51 are disposed in the second compartment 120. The evaporator 4 is disposed in a space between the first compartment 110 and the second compartment 120 in the unit 100.

In the evaporator 4 in Embodiment 2, the heat-transfer tubes 42 in the first row and the heat-transfer tubes 42 in the second row are each disposed in such a manner that the linear distance L1 is shorter than the linear distance L2. The linear distance L1 and the linear distance L2 are described with reference to FIG. 8.

Figure 8:
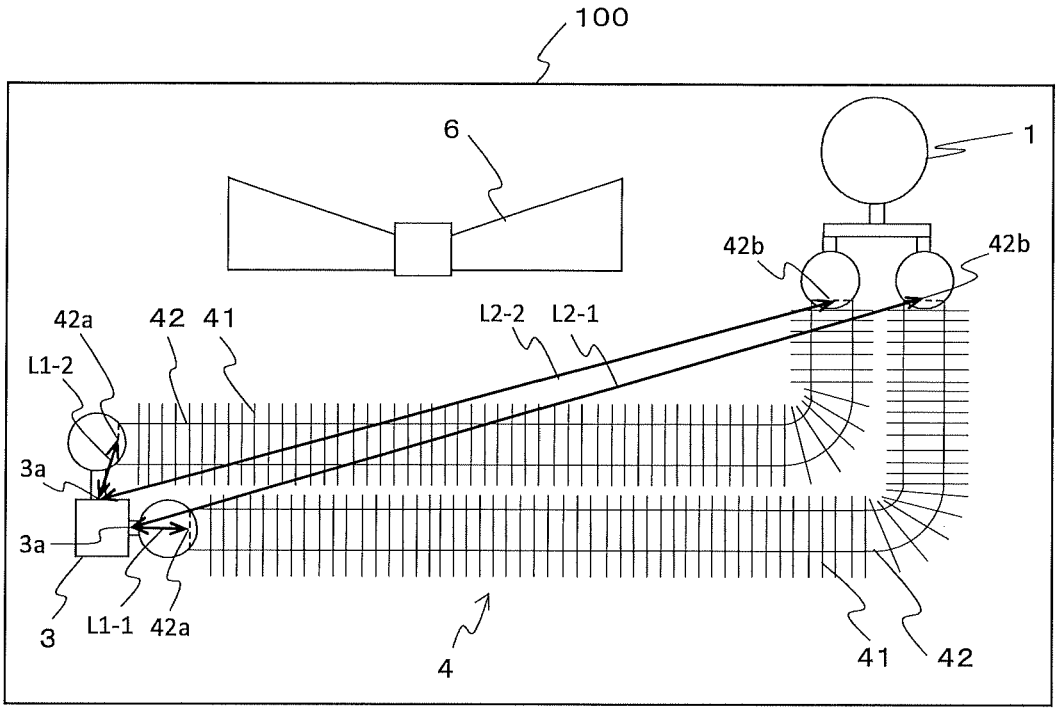
FIG. 8 is a schematic diagram illustrating a disposition in the unit of the refrigeration cycle apparatus according to Embodiment 2 of the present disclosure.

FIG. 8 is a schematic diagram illustrating a disposition in the unit of the refrigeration cycle apparatus according to Embodiment 2 of the present disclosure. FIG. 8 is a top view of the unit illustrating the disposition of each component. In FIG. 8, some components are not illustrated.

As illustrated in FIG. 8, the evaporator 4 is disposed in such a manner that a linear distance L1-1 between the end portion 42*a* of the refrigerant inlet of the heat-transfer tube 42 in the first row and the refrigerant outlet 3*a* of the pressure reducing device 3 is shorter than a linear distance L2-1 between the end portion 42*b* of the refrigerant outlet of the heat-transfer tube 42 in the first row and the refrigerant outlet 3*a* of the pressure reducing device 3. The evaporator 4 is disposed in such a manner that a linear distance L1-2 between the end portion 42*a* of the refrigerant inlet of the heat-transfer tube 42 in the second row and the refrigerant outlet 3*a* of the pressure reducing device 3 is shorter than a linear distance L2-2 between the end portion 42*b* of the refrigerant outlet of the heat-transfer tube 42 in the second row and the refrigerant outlet 3*a* of the pressure reducing device 3.

In addition, in the evaporator 4 in Embodiment 2, the heat-transfer tubes 42 in the first row and the heat-transfer tubes 42 in the second row are each disposed in such a manner that the linear distance L3 is shorter than the linear distance L4. The linear distance L3 and the linear distance L4 are described with reference to FIG. 9.

Figure 9:
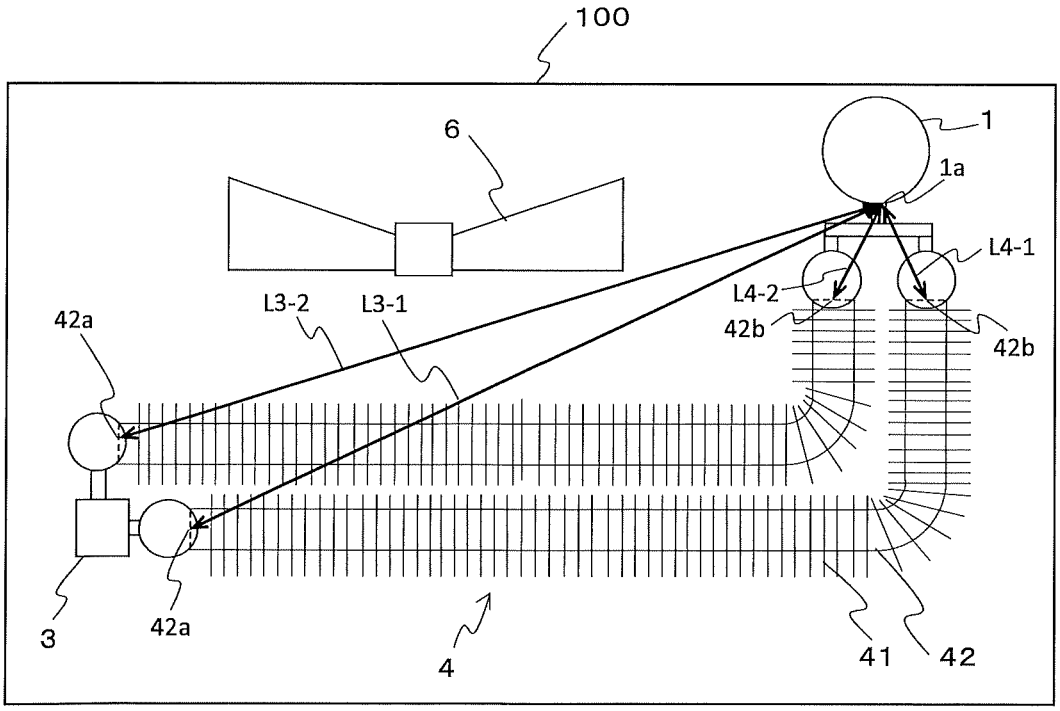
FIG. 9 is a schematic diagram illustrating a disposition in the unit of the refrigeration cycle apparatus according to Embodiment 2 of the present disclosure.

FIG. 9 is a schematic diagram illustrating a disposition in the unit of the refrigeration cycle apparatus according to Embodiment 2 of the present disclosure. FIG. 9 is a top view of the unit illustrating the disposition of each component.

As illustrated in FIG. 9, the evaporator 4 is disposed in such a manner that a linear distance L3-1 between the end portion 42*b* of the refrigerant outlet of the heat-transfer tube 42 in the first row and the refrigerant inlet 1*a* of the compressor 1 is shorter than a linear distance L4-1 between the end portion 42*a* of the refrigerant inlet of the heat-transfer tube 42 in the first row and the refrigerant inlet 1*a* of the compressor 1. The evaporator 4 is disposed in such a manner that a linear distance L3-2 between the end portion 42*b* of the refrigerant outlet of the heat-transfer tube 42 in the second row and the refrigerant inlet 1*a* of the compressor 1 is shorter than a linear distance L4-2 between the end portion 42*a* of the refrigerant inlet of the heat-transfer tube 42 in the second row and the refrigerant inlet 1*a* of the compressor 1.

With such a configuration, similarly to Embodiment 1 above, it is possible to shorten the length of the refrigerant pipe between the refrigerant inlet of the evaporator 4 and the refrigerant outlet 3*a* of the pressure reducing device 3. In addition, it is possible to shorten the length of the refrigerant pipe between the refrigerant outlet of the evaporator 4 and the refrigerant inlet 1*a* of the compressor 1. As a result, it is possible to satisfy a desired COP with a reduced filling amount of a refrigerant including a refrigerant having flammability.

Embodiment 3

A configuration of a refrigeration cycle apparatus according to Embodiment 3 is described below with the focus on the differences between Embodiment 1 and Embodiment 2 above and Embodiment 3. The same parts as those in Embodiment 1 and Embodiment 2 above have the same reference signs and are not described.

Figure 10:
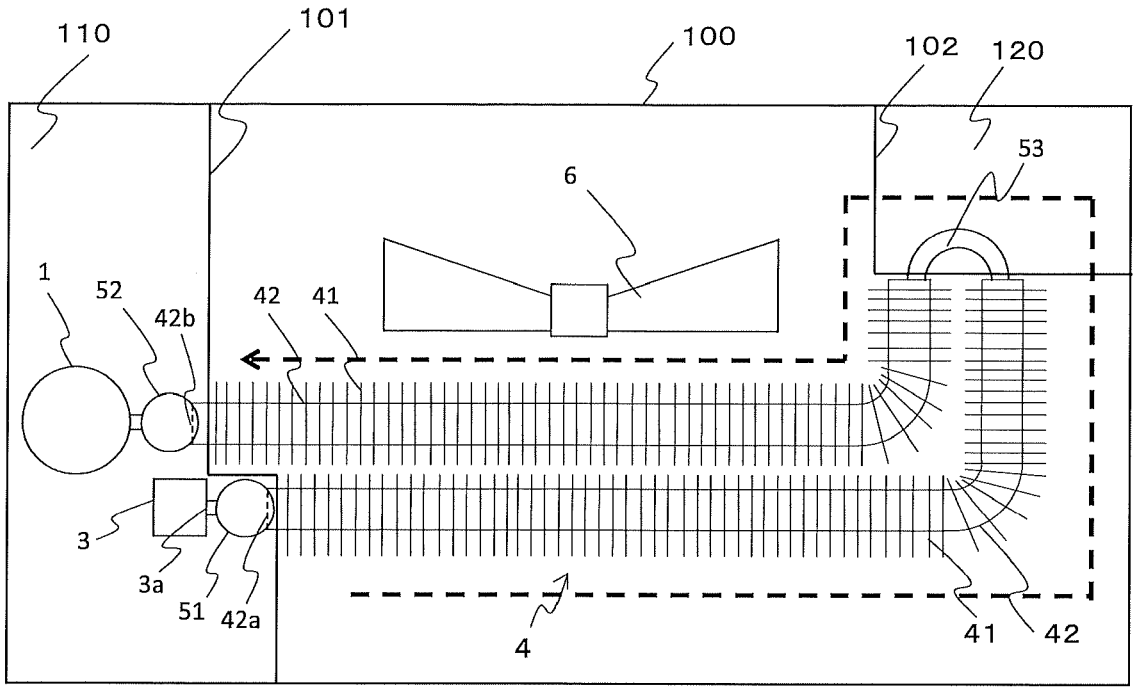
FIG. 10 is a schematic diagram illustrating a disposition in a unit of a refrigeration cycle apparatus according to Embodiment 3 of the present disclosure.

FIG. 10 is a schematic diagram illustrating a disposition in a unit of the refrigeration cycle apparatus according to Embodiment 3 of the present disclosure. FIG. 10 is a top view of the unit illustrating the disposition of each component. In FIG. 10, a refrigerant flow is represented by a dashed arrow.

As illustrated in FIG. 10, in the evaporator 4, the heat-transfer tubes 42 are disposed in two rows across a direction in which air flows. The heat-transfer tubes 42 disposed in two rows are disposed to curve to have an L shape in a top view to extend along sides of the unit 100.

Hereinafter, the heat-transfer tubes 42 disposed at positions away from the evaporator side fan 6 are referred to as the heat-transfer tubes 42 in the first row, and the heat-transfer tubes 42 disposed at positions close to the evaporator side fan 6 are referred to as the heat-transfer tubes 42 in the second row.

One end portion of the heat-transfer tube 42 in the first row is connected to the first header 51. One end portion of the heat-transfer tube 42 in the second row is connected to the second header 52. In addition, the other end portion of the heat-transfer tube 42 in the first row and the other end portion of the heat-transfer tube 42 in the second row are connected to each other by a connecting pipe 53. The connecting pipe 53 is composed of, for example, a U-pipe bent into a U shape. The refrigerant that has flowed out from the pressure reducing device 3 flows into the first header 51. The refrigerant that has flowed into the first header 51 passes through a refrigerant passage of the heat-transfer tube 42 in the first row. The refrigerant that has flowed out from the heat-transfer tube 42 in the first row flows into the heat-transfer tube 42 in the second row through the connecting pipe 53. The refrigerant that has flowed into the heat-transfer tube 42 in the second row passes through a refrigerant passage of the heat-transfer tube 42 in the second row and flows into the second header 52. The refrigerant that has flowed out from the second header 52 flows into the compressor 1. That is, in the evaporator 4 in Embodiment 3, the end portion 42*a* of the refrigerant inlet of the heat-transfer tube 42 in the first row is the refrigerant inlet of the evaporator 4. The end portion 42*b* of the refrigerant outlet of the heat-transfer tube 42 in the second row is the refrigerant outlet of the evaporator 4.

The compressor 1, the pressure reducing device 3, the first header 51, and the second header 52 are disposed in the first compartment 110. The connecting pipe 53 is disposed in the second compartment 120. The evaporator 4 is disposed in a space between the first compartment 110 and the second compartment 120 in the unit 100.

Figure 11:
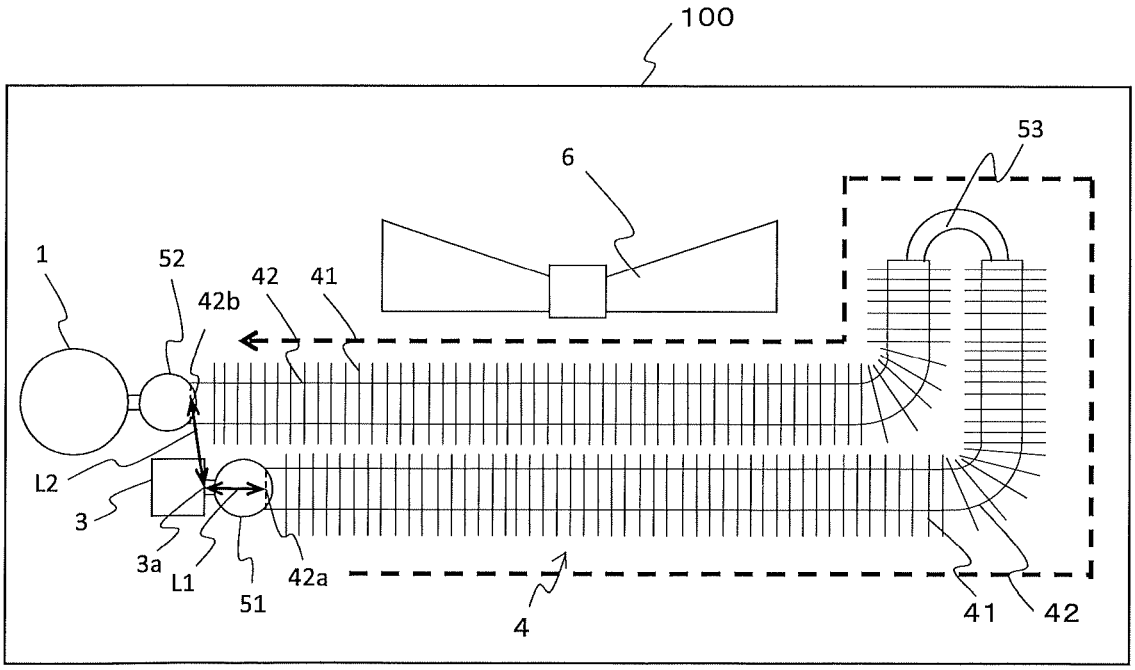
FIG. 11 is a schematic diagram illustrating a disposition in the unit of the refrigeration cycle apparatus according to Embodiment 3 of the present disclosure.

FIG. 11 is a schematic diagram illustrating a disposition in the unit of the refrigeration cycle apparatus according to Embodiment 3 of the present disclosure. FIG. 11 is a top view of the unit illustrating the disposition of each component. In FIG. 11, some components are not illustrated.

As illustrated in FIG. 11, the evaporator 4 in Embodiment 3 is disposed in the unit 100 in such a manner that the linear distance L1 between the end portion 42*a* of the heat-transfer tube 42 in the first row and the refrigerant outlet 3*a* of the pressure reducing device 3 is shorter than the linear distance L2 between the end portion 42*b* of the heat-transfer tube 42 in the second row and the refrigerant outlet of the pressure reducing device 3.

Figure 12:
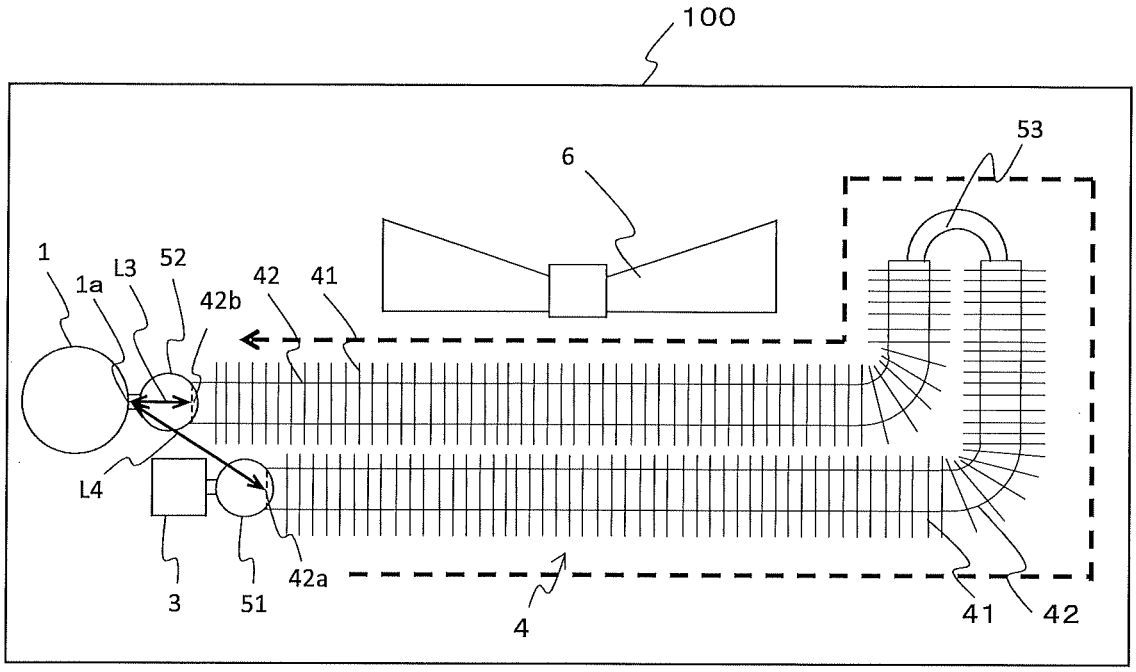
FIG. 12 is a schematic diagram illustrating a disposition in the unit of the refrigeration cycle apparatus according to Embodiment 3 of the present disclosure.

FIG. 12 is a schematic diagram illustrating a disposition in the unit of the refrigeration cycle apparatus according to Embodiment 3 of the present disclosure. FIG. 12 is a top view of the unit illustrating the disposition of each component. In FIG. 12, some components are not illustrated.

As illustrated in FIG. 12, the evaporator 4 is disposed in the unit 100 in such a manner that the linear distance L3 between the end portion 42*b* of the heat-transfer tube 42 in the second row and the refrigerant inlet 1*a* of the compressor 1 is shorter than the linear distance L4 between the end portion 42*a* of the heat-transfer tube 42 in the first row and the refrigerant inlet 1*a* of the compressor 1.

With such a configuration, similarly to Embodiment 1 above, it is possible to shorten the length of the refrigerant pipe between the refrigerant inlet of the evaporator 4 and the refrigerant outlet 3*a* of the pressure reducing device 3. In addition, it is possible to shorten the length of the refrigerant pipe between the refrigerant outlet of the evaporator 4 and the refrigerant inlet 1*a* of the compressor 1. As a result, it is possible to satisfy a desired COP with a reduced filling amount of a refrigerant including a refrigerant having flammability.

Embodiment 4

A configuration of a refrigeration cycle apparatus according to Embodiment 4 is described below with the focus on the differences between Embodiment 1 to Embodiment 3 above and Embodiment 4. The same parts as those in Embodiment 1 to Embodiment 3 above have the same reference signs and are not described.

Figure 13:
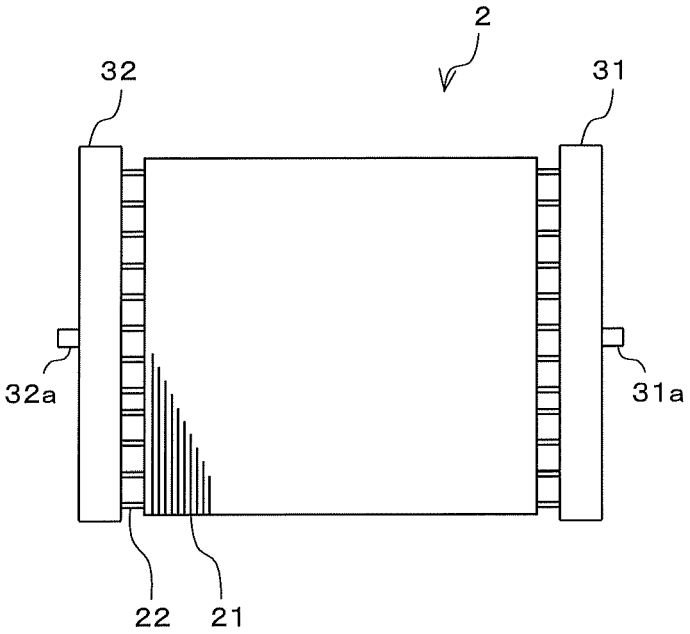
FIG. 13 is a side view illustrating a condenser of a refrigeration cycle apparatus according to Embodiment 4 of the present disclosure.

FIG. 13 is a side view illustrating a condenser of the refrigeration cycle apparatus according to Embodiment 4 of the present disclosure.

As illustrated in FIG. 13, the condenser 2 includes a plurality of fins 21 and a plurality of heat-transfer tubes 22. The fins 21 are each flat-plate shaped and are disposed in parallel to each other with a distance between the fins 21. Air flows between the fins 21. The heat-transfer tubes 22 are disposed in parallel to each other and are attached to the fins 21. The heat-transfer tubes 22 each contain a refrigerant passage. The heat-transfer tubes 22 are flat tubes whose sections orthogonal to the axis of the refrigerant passage have a flat shape. The heat-transfer tubes 22 are disposed in such a manner that the major axis of each section having a flat shape is parallel to a direction in which air flows.

One end portion of each of the heat-transfer tubes 22 is connected to a third header 31, and the other end portion is connected to a fourth header 32. The third header 31 diverts, into each of the heat-transfer tubes 22, the refrigerant flowing into the third header 31 from an inlet 31*a*. The fourth header 32 collects the refrigerant flowing into the fourth header 32 from each of the heat-transfer tubes 22, and the refrigerant flows out from an outlet 32*a*.

Figure 14:
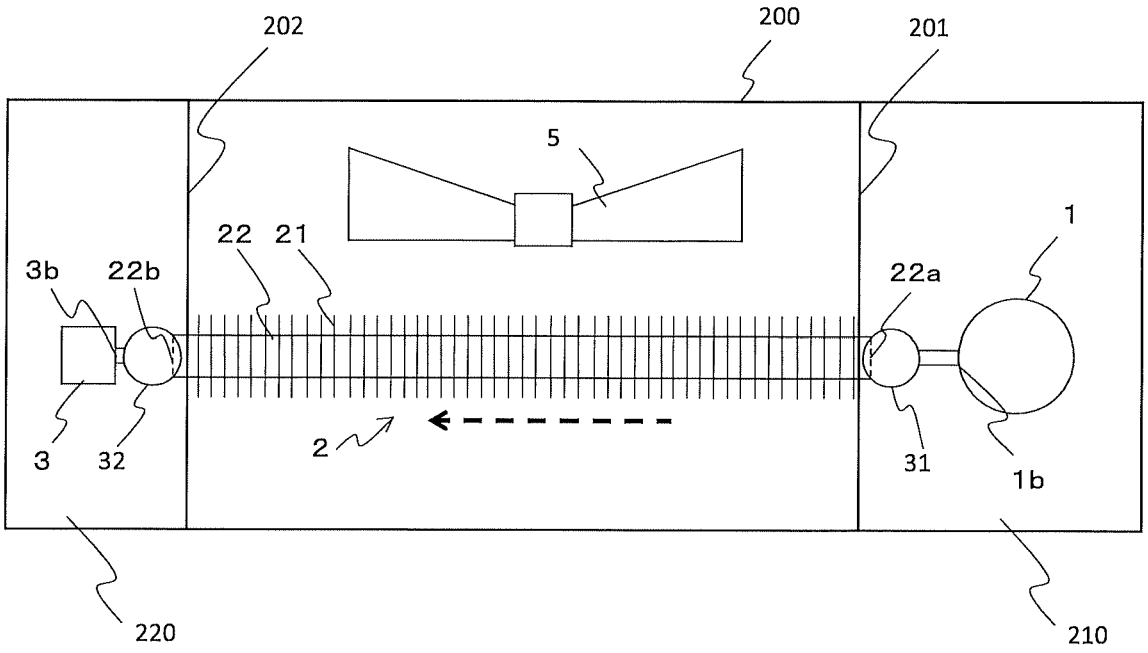
FIG. 14 is a schematic diagram illustrating a disposition in a unit of the refrigeration cycle apparatus according to Embodiment 4 of the present disclosure.
Figure 15:
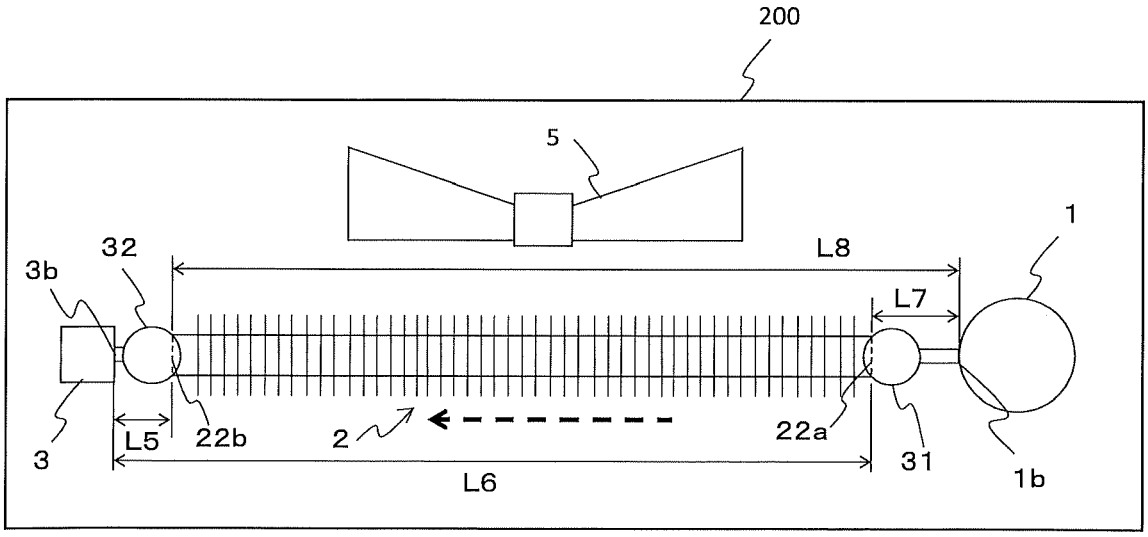
FIG. 15 is a schematic diagram illustrating a disposition in the unit of the refrigeration cycle apparatus according to Embodiment 4 of the present disclosure.

FIGS. 14 and 15 are schematic diagrams each illustrating a disposition in a unit of the refrigeration cycle apparatus according to Embodiment 4 of the present disclosure. FIGS. 14 and 15 are top views of the unit each illustrating the disposition of each component. In FIGS. 14 and 15, a refrigerant flow is represented by a dashed arrow. In FIG. 15, some components are not illustrated.

As illustrated in FIG. 14, the compressor 1, the pressure reducing device 3, and the condenser 2 are accommodated in a unit 200. The unit 200 is, for example, an outdoor unit in an air-conditioning apparatus. In addition, airflow paths through which air flows are formed in the unit 200, and the air sent from the condenser side fan 5 passes through the condenser 2. In addition, the unit 200 includes a first compartment 210, which is partitioned off by a partition wall 201. The compressor 1 and the third header 31 are disposed in the first compartment 210. In addition to the first compartment 210, the unit 200 includes a second compartment 220, which is partitioned off by a partition wall 202. The pressure reducing device 3 and the fourth header 32 are disposed in the second compartment 220. The condenser 2 is disposed in a space between the first compartment 210 and the second compartment 220 in the unit 200.

As illustrated in FIG. 15, the condenser 2 is disposed in the unit 200 in such a manner that a linear distance L5 between a refrigerant outlet of the condenser 2 and a refrigerant inlet 3*b* of the pressure reducing device 3 is shorter than a linear distance L6 between a refrigerant inlet of the condenser 2 and the refrigerant inlet 3*b* of the pressure reducing device 3. The refrigerant inlet of the condenser 2 is one of end portions 22*a* of refrigerant inlets of the heat-transfer tubes 22. The refrigerant outlet of the condenser 2 is one of end portions 22*b* of refrigerant outlets of the heat-transfer tubes 22. Examples of the linear distance L5 and the linear distance L6 are described with reference to FIG. 16.

Figure 16:
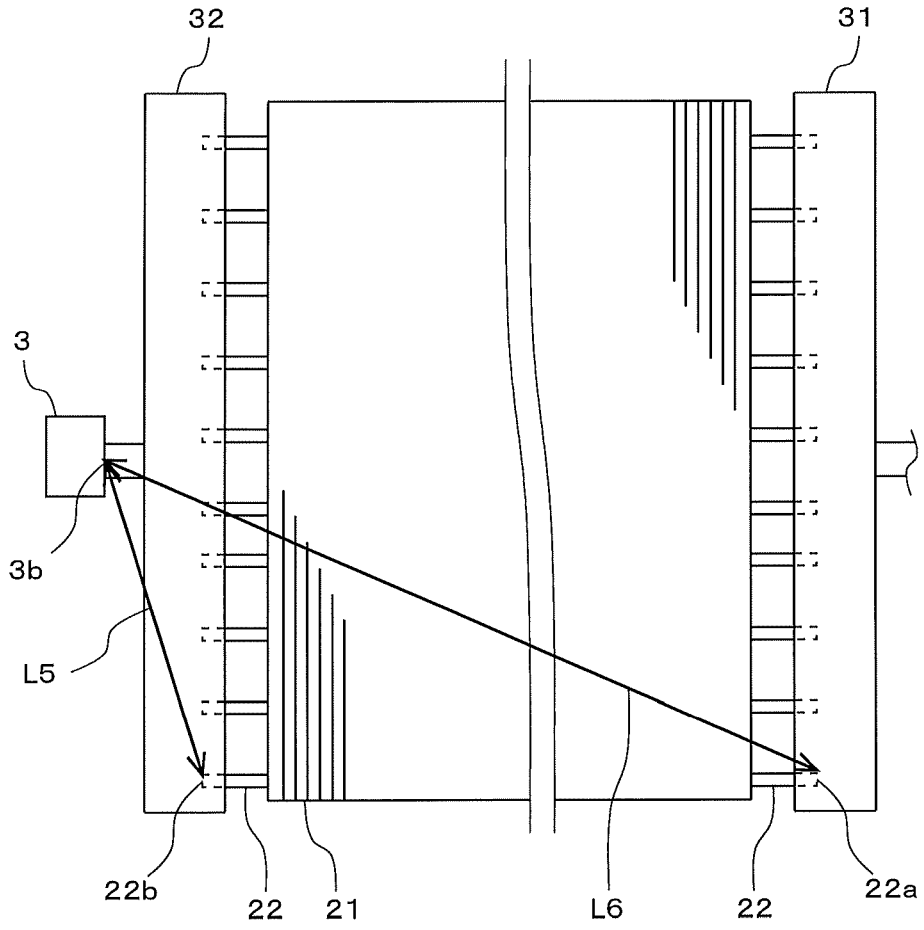
FIG. 16 is a side view illustrating the condenser of the refrigeration cycle apparatus according to Embodiment 4 of the present disclosure.

FIG. 16 is a side view illustrating the condenser of the refrigeration cycle apparatus according to Embodiment 4 of the present disclosure.

As illustrated in FIG. 16, the linear distance L5 is the linear distance between the refrigerant inlet 3*b* of the pressure reducing device 3 and the end portion 22*b* farthest from the refrigerant inlet 3*b* of the pressure reducing device 3 among the end portions 22*b* of the refrigerant outlets of the heat-transfer tubes 22. The linear distance L6 is the linear distance between the refrigerant inlet 3*b* of the pressure reducing device 3 and the end portion 22*a* farthest from the refrigerant inlet 3*b* of the pressure reducing device 3 among the end portions 22*a* of the refrigerant inlets of the heat-transfer tubes 22.

The linear distance L5 and the linear distance L6 are not limited to these illustrated in FIG. 16. For example, the linear distance L5 may be the linear distance between the refrigerant inlet 3*b* of the pressure reducing device 3 and the end portion 22*b* closest to the refrigerant inlet 3*b* of the pressure reducing device 3 among the end portions 22*b* of the refrigerant outlets of the heat-transfer tubes 22. The linear distance L6 may be the linear distance between the refrigerant inlet 3*b* of the pressure reducing device 3 and the end portion 22*a* closest to the refrigerant inlet 3*b* of the pressure reducing device 3 among the end portions 22*a* of the refrigerant inlets of the heat-transfer tubes 22.

FIG. 15 is referred to again. The condenser 2 is disposed in the unit 200 in such a manner that a linear distance L7 between the refrigerant inlet of the condenser 2 and a refrigerant outlet 1*b* of the compressor 1 is shorter than a linear distance L8 between the refrigerant outlet of the condenser 2 and the refrigerant outlet 1*b* of the compressor 1. The refrigerant inlet of the condenser 2 is one of the end portions 22*a* of the refrigerant inlets of the heat-transfer tubes 22. The refrigerant outlet of the condenser 2 is one of the end portions 22*b* of the refrigerant outlets of the heat-transfer tubes 22. Examples of the linear distance L7 and the linear distance L8 are described with reference to FIG. 17.

Figure 17:
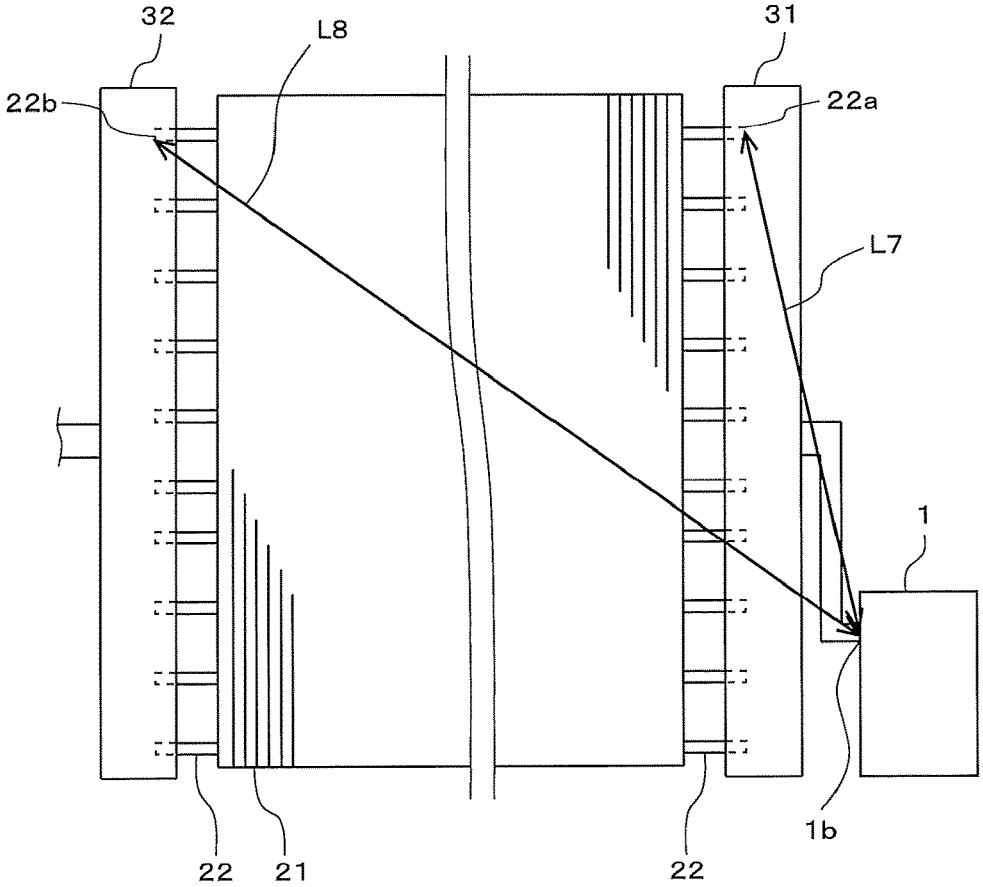
FIG. 17 is a side view illustrating the condenser of the refrigeration cycle apparatus according to Embodiment 4 of the present disclosure.

FIG. 17 is a side view illustrating the condenser of the refrigeration cycle apparatus according to Embodiment 4 of the present disclosure.

As illustrated in FIG. 17, the linear distance L7 is the linear distance between the refrigerant outlet 1*b* of the compressor 1 and the end portion 22*a* farthest from the refrigerant outlet 1*b* of the compressor 1 among the end portions 22*a* of the refrigerant inlets of the heat-transfer tubes 22. The linear distance L8 is the linear distance between the refrigerant outlet 1*b* of the compressor 1 and the end portion 22*b* farthest from the refrigerant outlet 1*b* of the compressor 1 among the end portions 22*b* of the refrigerant outlets of the heat-transfer tubes 22.

The linear distance L7 and the linear distance L8 are not limited to these illustrated in FIG. 17. For example, the linear distance L7 may be the linear distance between the refrigerant outlet 1*b* of the compressor 1 and the end portion 22*a* closest to the refrigerant outlet 1*b* of the compressor 1 among the end portions 22*a* of the refrigerant inlets of the heat-transfer tubes 22. The linear distance L8 may be the linear distance between the refrigerant outlet 1*b* of the compressor 1 and the end portion 22*b* closest to the refrigerant outlet 1*b* of the compressor 1 among the end portions 22*b* of the refrigerant outlets of the heat-transfer tubes 22.

As described above, in Embodiment 4, a refrigerant including a refrigerant having flammability is used as refrigerant circulating in the refrigerant circuit 10. The condenser 2 and the pressure reducing device 3 are accommodated in the unit 200. The condenser 2 is disposed in the unit 200 in such a manner that the linear distance L5 between the refrigerant outlet of the condenser 2 and the refrigerant inlet 3*b* of the pressure reducing device 3 is shorter than the linear distance L6 between the refrigerant inlet of the condenser 2 and the refrigerant inlet 3*b* of the pressure reducing device 3.

Thus, the length of the refrigerant pipe between the refrigerant outlet of the condenser 2 and the refrigerant inlet 3*b* of the pressure reducing device 3 can be shorter than the length in the case in which the linear distance L5 is longer than or equal to the linear distance L6. Accordingly, the amount of the liquid refrigerant in the refrigerant pipe can be smaller than the amount in the case in which the linear distance L5 is longer than or equal to the linear distance L6. As a result, it is possible to satisfy a desired COP with a reduced filling amount of a refrigerant including a refrigerant having flammability. In addition, the pressure loss of the liquid refrigerant can be reduced by shortening the length of the refrigerant pipe between the refrigerant inlet of the evaporator and the refrigerant inlet 3*b* of the pressure reducing device 3.

In addition, in Embodiment 4, the compressor 1 is accommodated in the unit 200. The evaporator is disposed in the unit 200 in such a manner that the linear distance L7 between the refrigerant inlet of the condenser 2 and the refrigerant outlet 1*b* of the compressor 1 is shorter than the linear distance L8 between the refrigerant outlet of the condenser 2 and the refrigerant outlet 1*b* of the compressor 1.

Thus, the length of the refrigerant pipe between the refrigerant inlet of the condenser 2 and the refrigerant outlet 1*b* of the compressor 1 can be shorter than the length in the case in which the linear distance L7 is longer than or equal to the linear distance L8. Accordingly, the amount of the gas refrigerant in the refrigerant pipe can be smaller than the amount in the case in which the linear distance L7 is longer than or equal to the linear distance L8. As a result, it is possible to satisfy a desired COP with a reduced filling amount of a refrigerant including a refrigerant having flammability. In addition, the pressure loss of the gas refrigerant can be reduced by shortening the length of the refrigerant pipe between the refrigerant inlet of the evaporator and the refrigerant inlet 3*b* of the pressure reducing device 3.

Embodiment 5

A configuration of a refrigeration cycle apparatus according to Embodiment 5 is described below with the focus on the differences between Embodiment 1 to Embodiment 4 above and Embodiment 5. The same parts as those in Embodiment 1 to Embodiment 4 above have the same reference signs and are not described.

Figure 18:
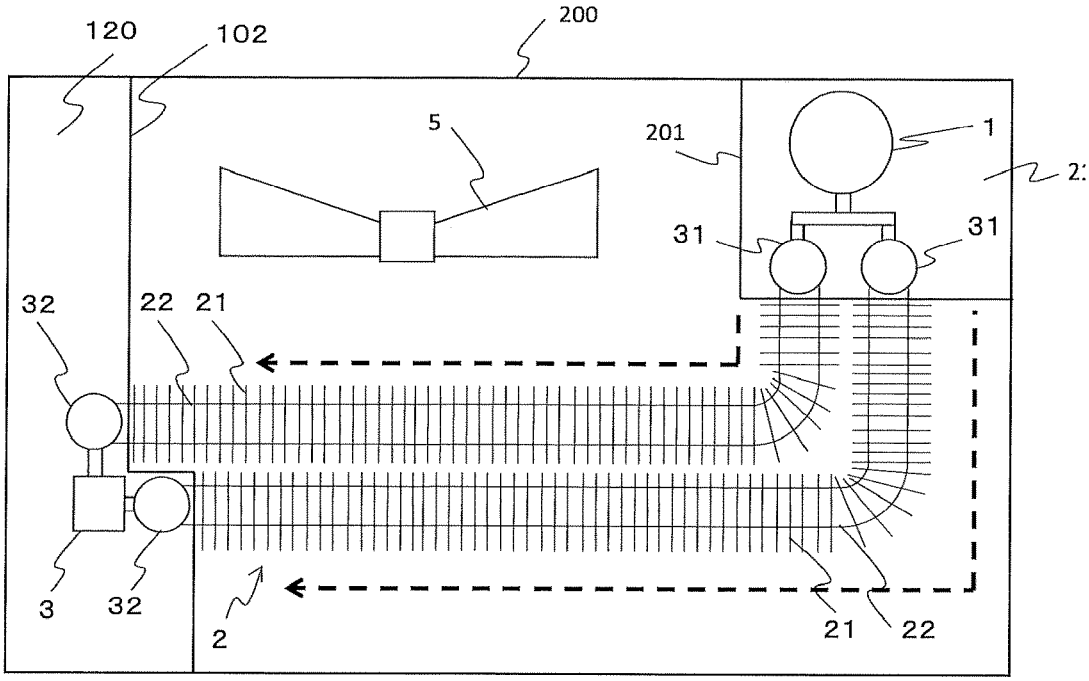
FIG. 18 is a schematic diagram illustrating a disposition in a unit of a refrigeration cycle apparatus according to Embodiment 5 of the present disclosure.

FIG. 18 is a schematic diagram illustrating a disposition in a unit of the refrigeration cycle apparatus according to Embodiment 5 of the present disclosure. FIG. 18 is a top view of the unit illustrating the disposition of each component. In FIG. 18, a refrigerant flow is represented by a dashed arrow.

As illustrated in FIG. 17, in the condenser 2, the heat-transfer tubes 22 are disposed in two rows across a direction in which air flows. The heat-transfer tubes 22 disposed in two rows are disposed to curve to have an L shape in a top view to extend along sides of the unit 200.

Hereinafter, the heat-transfer tubes 22 disposed at positions away from the condenser side fan 5 are referred to as the heat-transfer tubes 22 in the first row, and the heat-transfer tubes 22 disposed at positions close to the condenser side fan 5 are referred to as the heat-transfer tubes 22 in the second row. Although FIG. 18 illustrates the heat-transfer tubes 22 disposed in two rows, the disposition is not limited to the illustration. The heat-transfer tubes 22 may be disposed in three or more rows.

The third headers 31 are disposed on the respective rows of the heat-transfer tubes 22. Each of the third headers 31 is connected to the compressor 1 by a refrigerant pipe. The fourth headers 32 are disposed on the respective rows of the heat-transfer tubes 22. Each of the fourth headers 32 is connected to the pressure reducing device 3 by a refrigerant pipe. The refrigerant that has flowed out from the compressor 1 flows into the two third headers 31. The refrigerant that has flowed out from the two fourth headers 32 flows into the pressure reducing device 3. That is, the condenser 2 is a parallel flow evaporator in which the refrigerant that has flowed into the heat-transfer tubes 22 in the first row and the refrigerant that has flowed into the heat-transfer tubes 22 in the second row flow in parallel to each other.

The compressor 1 and the two third headers 31 are disposed in the first compartment 210. The pressure reducing device 3 and the two fourth headers 32 are disposed in the second compartment 220. The condenser 2 is disposed in a space between the first compartment 210 and the second compartment 220 in the unit 200.

In the condenser 2 in Embodiment 5, the heat-transfer tubes 22 in the first row and the heat-transfer tubes 22 in the second row are each disposed in such a manner that the linear distance L5 is shorter than the linear distance L6. The linear distance L5 and the linear distance L6 are described with reference to FIG. 19.

Figure 19:
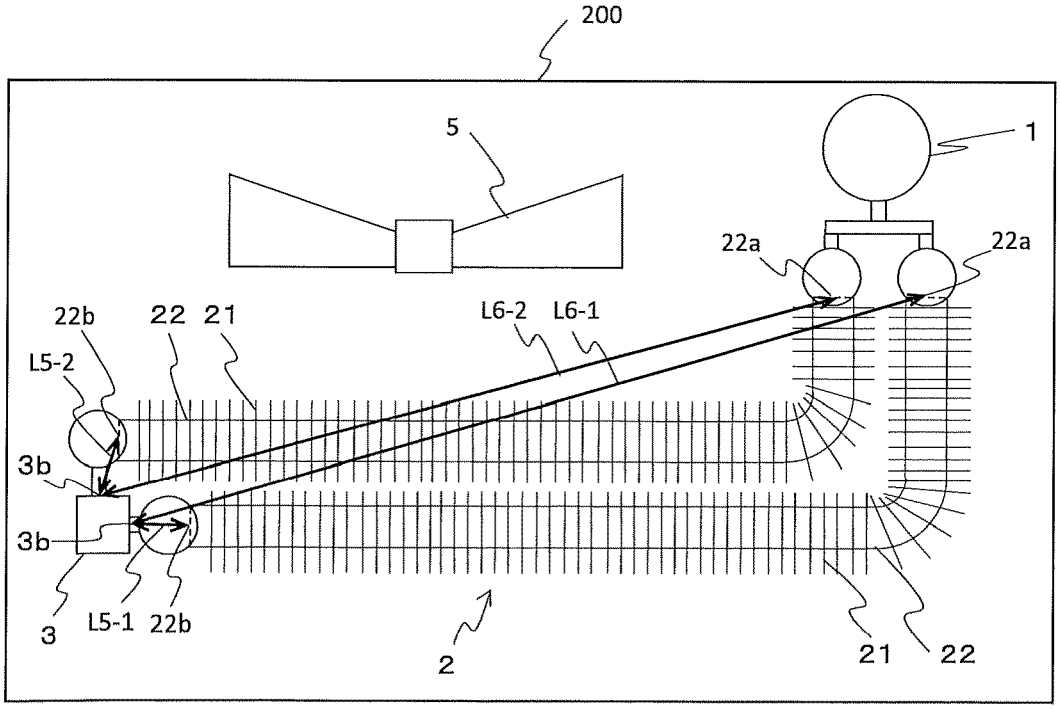
FIG. 19 is a schematic diagram illustrating a disposition in the unit of the refrigeration cycle apparatus according to Embodiment 5 of the present disclosure.

FIG. 19 is a schematic diagram illustrating a disposition in the unit of the refrigeration cycle apparatus according to Embodiment 5 of the present disclosure. FIG. 18 is a top view of the unit illustrating the disposition of each component. In FIG. 19, some components are not illustrated.

As illustrated in FIG. 19, the condenser 2 is disposed in such a manner that a linear distance L5-1 between the end portion 22*b* of the refrigerant outlet of the heat-transfer tube 22 in the first row and the refrigerant inlet 3*b* of the pressure reducing device 3 is shorter than a linear distance L6-1 between the end portion 22*a* of the refrigerant inlet of the heat-transfer tube 22 in the first row and the refrigerant inlet 3*b* of the pressure reducing device 3. The condenser 2 is disposed in such a manner that a linear distance L5-2 between the end portion 22*b* of the refrigerant inlet of the heat-transfer tube 22 in the second row and the refrigerant inlet 3*b* of the pressure reducing device 3 is shorter than a linear distance L6-2 between the end portion 22*a* of the refrigerant outlet of the heat-transfer tube 22 in the second row and the refrigerant inlet 3*b* of the pressure reducing device 3.

In addition, in the condenser 2 in Embodiment 5, the heat-transfer tubes 22 in the first row and the heat-transfer tubes 22 in the second row are each disposed in such a manner that the linear distance L7 is shorter than the linear distance L8. The linear distance L7 and the linear distance L8 are described with reference to FIG. 20.

Figure 20:
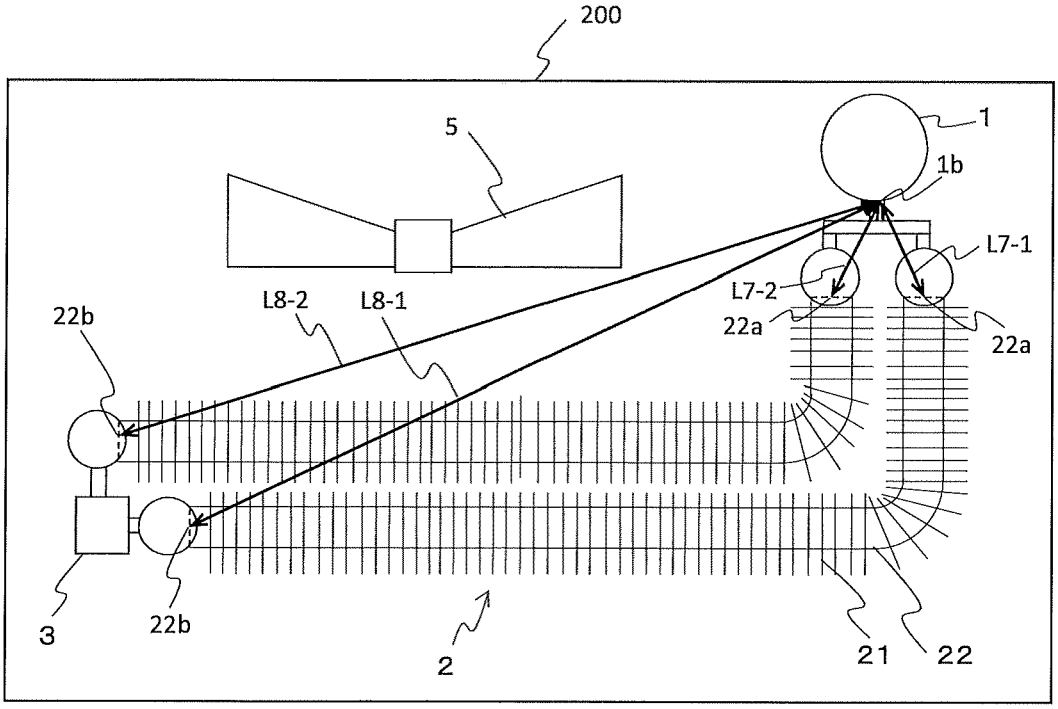
FIG. 20 is a schematic diagram illustrating a disposition in the unit of the refrigeration cycle apparatus according to Embodiment 5 of the present disclosure.

FIG. 20 is a schematic diagram illustrating a disposition in the unit of the refrigeration cycle apparatus according to Embodiment 5 of the present disclosure. FIG. 20 is a top view of the unit illustrating the disposition of each component.

As illustrated in FIG. 20, the condenser 2 is disposed in such a manner that a linear distance L7-1 between the end portion 22*a* of the refrigerant inlet of the heat-transfer tube 22 in the first row and the refrigerant outlet 1*b* of the compressor 1 is shorter than a linear distance L8-1 between the end portion 22*b* of the refrigerant outlet of the heat-transfer tube 22 in the first row and the refrigerant outlet 1*b* of the compressor 1. The condenser 2 is disposed in such a manner that a linear distance L7-2 between the end portion 22*a* of the refrigerant inlet of the heat-transfer tube 22 in the second row and the refrigerant outlet 1*b* of the compressor 1 is shorter than a linear distance L8-2 between the end portion 22*b* of the refrigerant outlet of the heat-transfer tube 22 in the second row and the refrigerant outlet 1*b* of the compressor 1.

With such a configuration, similarly to Embodiment 4 above, it is possible to shorten the length of the refrigerant pipe between the refrigerant inlet of the condenser 2 and the refrigerant inlet 3*b* of the pressure reducing device 3. In addition, it is possible to shorten the length of the refrigerant pipe between the refrigerant inlet of the condenser 2 and the refrigerant outlet 1*b* of the compressor 1. As a result, it is possible to satisfy a desired COP with a reduced filling amount of a refrigerant including a refrigerant having flammability.

Embodiment 6

A configuration of a refrigeration cycle apparatus according to Embodiment 3 is described below with the focus on the differences between Embodiment 1 to Embodiment 5 above and Embodiment 6. The same parts as those in Embodiment 1 to Embodiment 5 above have the same reference signs and are not described.

Figure 21:
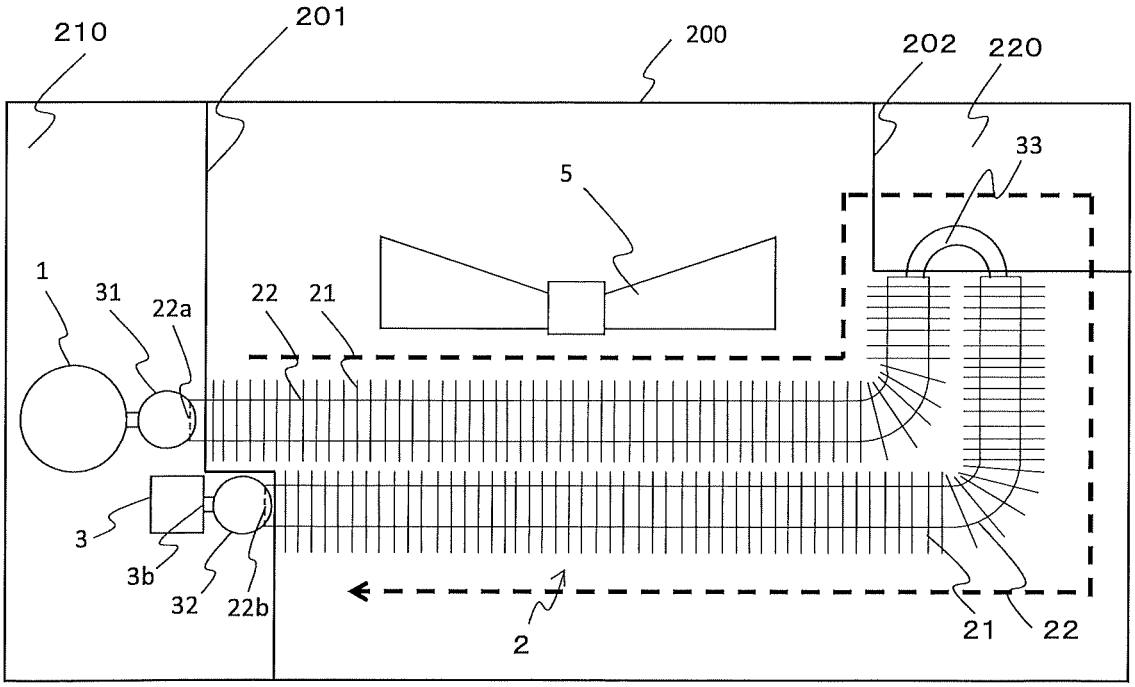
FIG. 21 is a schematic diagram illustrating a disposition in a unit of a refrigeration cycle apparatus according to Embodiment 6 of the present disclosure.

FIG. 21 is a schematic diagram illustrating a disposition in a unit of a refrigeration cycle apparatus according to Embodiment 6 of the present disclosure. FIG. 21 is a top view of the unit illustrating the disposition of each component. In FIG. 21, a refrigerant flow is represented by a dashed arrow.

As illustrated in FIG. 21, in the condenser 2, the heat-transfer tubes 22 are disposed in two rows across a direction in which air flows. The heat-transfer tubes 22 disposed in two rows are disposed to curve to have an L shape in a top view to extend along sides of the unit 200.

Hereinafter, the heat-transfer tubes 22 disposed at positions away from the condenser side fan 5 are referred to as the heat-transfer tubes 22 in the first row, and the heat-transfer tubes 22 disposed at positions close to the condenser side fan 5 are referred to as the heat-transfer tubes 22 in the second row.

One end portion of the heat-transfer tube 22 in the first row is connected to the fourth header 32. One end portion of the heat-transfer tube 22 in the second row is connected to the third header 31. In addition, the other end portion of the heat-transfer tube 22 in the first row and the other end portion of the heat-transfer tube 22 in the second row are connected to each other by a connecting pipe 33. The connecting pipe 33 is composed of, for example, a U-pipe bent into a U shape. The refrigerant that has flowed out from the compressor 1 flows into the third header 31. The refrigerant that has flowed into the third header 31 passes through a refrigerant passage of the heat-transfer tube 22 in the second row. The refrigerant that has flowed out from the heat-transfer tube 22 in the second row flows into the heat-transfer tube 22 in the first row through the connecting pipe 33. The refrigerant that has flowed into the heat-transfer tube 22 in the first row passes through a refrigerant passage of the heat-transfer tube 22 in the first row and flows into the fourth header 32. The refrigerant that has flowed out from the fourth header 32 flows into the pressure reducing device 3. That is, in the condenser 2 in Embodiment 6, the end portion 22*a* of the refrigerant inlet of the heat-transfer tube 22 in the second row is the refrigerant inlet of the condenser 2. The end portion 22*b* of the refrigerant outlet of the heat-transfer tube 22 in the first row is the refrigerant outlet of the condenser 2.

The compressor 1, the pressure reducing device 3, the third header 31, and the fourth header 32 are disposed in the first compartment 210. The connecting pipe 33 is disposed in the second compartment 220. The condenser 2 is disposed in a space between the first compartment 210 and the second compartment 220 in the unit 200.

Figure 22:
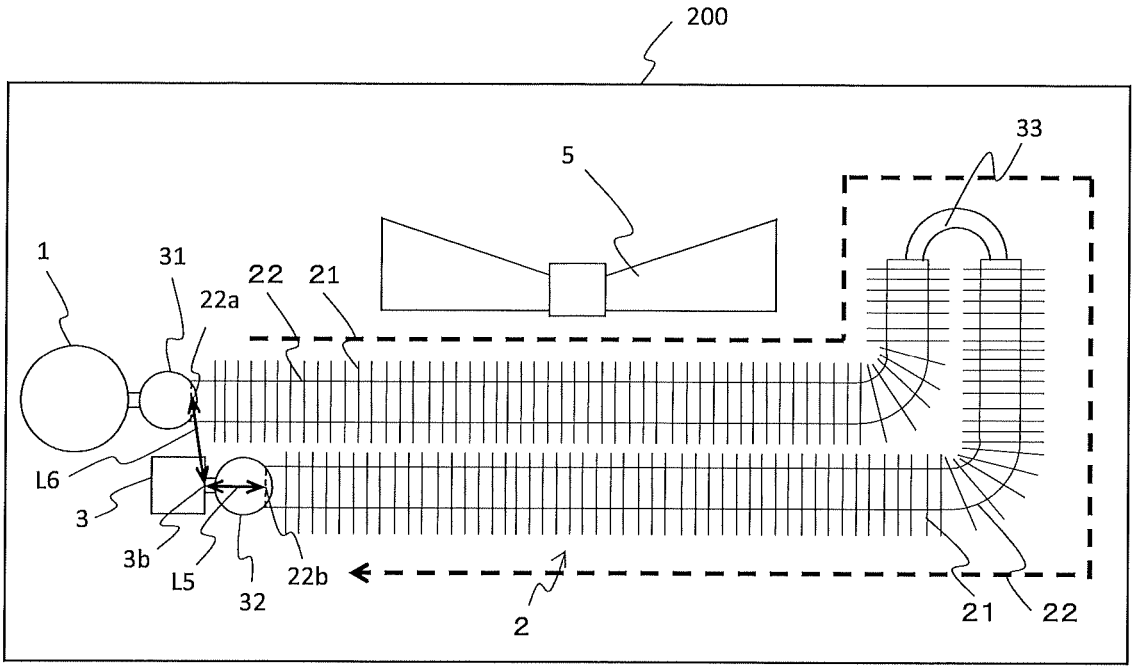
FIG. 22 is a schematic diagram illustrating a disposition in the unit of the refrigeration cycle apparatus according to Embodiment 6 of the present disclosure.

FIG. 22 is a schematic diagram illustrating a disposition in the unit of the refrigeration cycle apparatus according to Embodiment 6 of the present disclosure. FIG. 22 is a top view of the unit illustrating the disposition of each component. In FIG. 22, some components are not illustrated.

As illustrated in FIG. 22, the condenser 2 in Embodiment 6 is disposed in the unit 200 in such a manner that the linear distance L5 between the end portion 22*b* of the heat-transfer tube 22 in the first row and the refrigerant inlet 3*b* of the pressure reducing device 3 is shorter than the linear distance L6 between the end portion 22*a* of the heat-transfer tube 22 in the second row and the refrigerant inlet 3*b* of the pressure reducing device 3.

Figure 23:
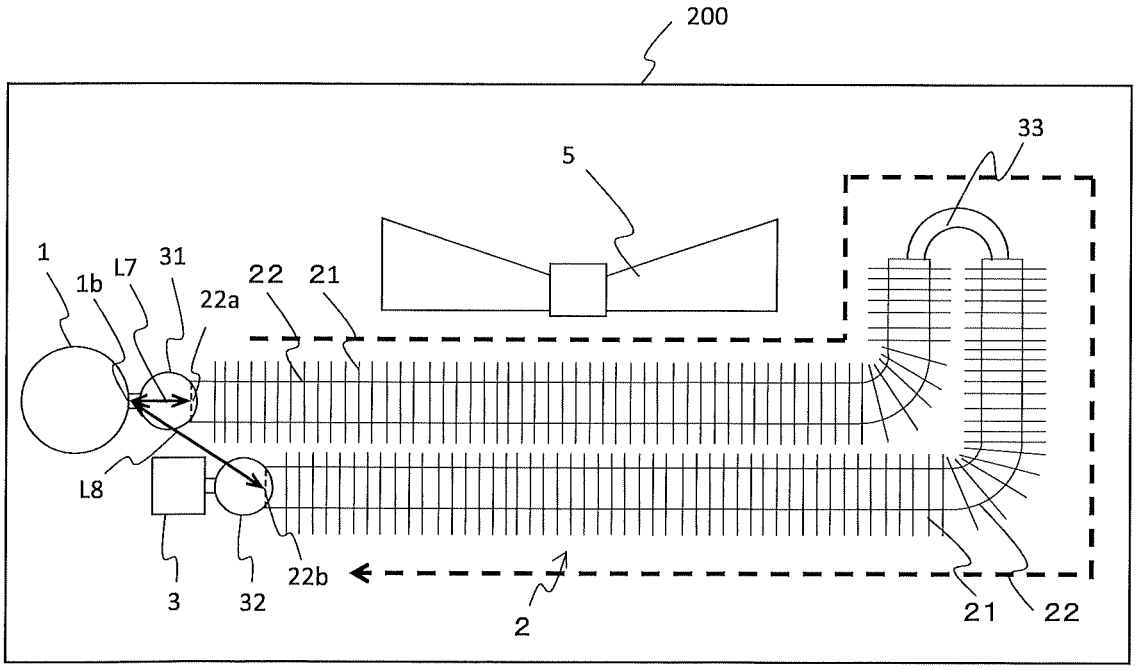
FIG. 23 is a schematic diagram illustrating a disposition in the unit of the refrigeration cycle apparatus according to Embodiment 6 of the present disclosure.

FIG. 23 is a schematic diagram illustrating a disposition in the unit of the refrigeration cycle apparatus according to Embodiment 6 of the present disclosure. FIG. 23 is a top view of the unit illustrating the disposition of each component. In FIG. 23, some components are not illustrated.

As illustrated in FIG. 23, the condenser 2 is disposed in the unit 200 in such a manner that the linear distance L7 between the end portion 22*a* of the heat-transfer tube 22 in the second row and the refrigerant outlet 1*b* of the compressor 1 is shorter than the linear distance L8 between the end portion 22*b* of the heat-transfer tube 22 in the first row and the refrigerant outlet 1*b* of the compressor 1.

With such a configuration, similarly to Embodiment 4 above, it is possible to shorten the length of the refrigerant pipe between the refrigerant outlet of the condenser 2 and the refrigerant inlet 3*b* of the pressure reducing device 3. In addition, it is possible to shorten the length of the refrigerant pipe between the refrigerant inlet of the condenser 2 and the refrigerant outlet 1*b* of the compressor 1. As a result, it is possible to satisfy a desired COP with a reduced filling amount of a refrigerant including a refrigerant having flammability.

REFERENCE SIGNS LIST

1 compressor 1*a* refrigerant inlet 1*b* refrigerant outlet 2 condenser 3 pressure reducing device 3*a* refrigerant outlet 3*b* refrigerant inlet 4 evaporator 5 condenser side fan 6 evaporator side fan 10 refrigerant circuit 21 fin 22 heat-transfer tube 22*a* end portion 22*b* end portion 31 third header 31*a* inlet 32 fourth header 32*a* outlet 33 connecting pipe 41 fin 42 heat-transfer tube 42*a* end portion 42*b* end portion 51 first header 51*a* inlet 52 second header 52*a* outlet 53 connecting pipe 100 unit 101 partition wall 102 partition wall 110 first compartment 120 second compartment 200 unit 201 partition wall 202 partition wall 210 first compartment 220 second compartment

The invention claimed is:

1. A refrigeration cycle apparatus comprising a refrigerant circuit including a compressor, a condenser, a pressure reducing device, and an evaporator connected by a refrigerant pipe, a refrigerant including a refrigerant having flammability being used as refrigerant circulating in the refrigerant circuit, the compressor, the condenser, and the pressure reducing device being accommodated in a unit, the condenser being disposed in the unit in such a manner that a linear distance between a refrigerant outlet of the condenser and a refrigerant inlet of the pressure reducing device is shorter than a linear distance between a refrigerant inlet of the condenser and the refrigerant inlet of the pressure reducing device, the unit including a first compartment in which the compressor is disposed and a second compartment in which the pressure reducing device is disposed, and the condenser being disposed between the first compartment and the second compartment in the unit.

2. The refrigeration cycle apparatus of claim 1, wherein the condenser is a flat tube heat exchanger including a flat tube through which refrigerant passes, and a fin attached to the flat tube.

3. The refrigeration cycle apparatus of claim 2, wherein the refrigerant inlet of the condenser is an end portion of a refrigerant inlet of the flat tube, and the refrigerant outlet of the condenser is an end portion of a refrigerant outlet of the flat tube.

4. The refrigeration cycle apparatus of claim 1, wherein the condenser is disposed in the unit in such a manner that a linear distance between the refrigerant inlet of the condenser and a refrigerant inlet of the compressor is shorter than a linear distance between the refrigerant outlet of the condenser and the refrigerant inlet of the compressor.

5. A refrigeration cycle apparatus comprising a refrigerant circuit including a compressor, a condenser, a pressure reducing device, and an evaporator connected by a refrigerant pipe, a refrigerant including a refrigerant having flammability being used as refrigerant circulating in the refrigerant circuit, the evaporator and the pressure reducing device being accommodated in a unit, the evaporator being disposed in the unit in such a manner that a linear distance between a refrigerant inlet of the evaporator and a refrigerant outlet of the pressure reducing device is shorter than a linear distance between a refrigerant outlet of the evaporator and the refrigerant outlet of the pressure reducing device, the unit including a first compartment in which the compressor is disposed and a second compartment in which the pressure reducing device is disposed, the evaporator being disposed between the first compartment and the second compartment in the unit.

6. The refrigeration cycle apparatus of claim 5, wherein the evaporator is a flat tube heat exchanger including a flat tube through which refrigerant passes, and a fin attached to the flat tube.

7. The refrigeration cycle apparatus of claim 6, wherein the refrigerant inlet of the evaporator is an end portion of a refrigerant inlet of the flat tube, and the refrigerant outlet of the evaporator is an end portion of a refrigerant outlet of the flat tube.

8. The refrigeration cycle apparatus of claim 5, wherein the refrigerant having flammability is a hydrocarbon-based natural refrigerant.

9. The refrigeration cycle apparatus of claim 5, wherein the evaporator is disposed in the unit in such a manner that a linear distance between the refrigerant outlet of the evaporator and a refrigerant inlet of the compressor is shorter than a linear distance between the refrigerant inlet of the evaporator and the refrigerant inlet of the compressor.

10. A refrigeration cycle apparatus comprising a refrigerant circuit including a compressor, a condenser, a pressure reducing device, and an evaporator connected by a refrigerant pipe, a refrigerant including a refrigerant having flammability being used as refrigerant circulating in the refrigerant circuit, wherein the evaporator and the pressure reducing device is accommodated in a unit, the evaporator is disposed in the unit in such a manner that a linear distance between a refrigerant inlet of the evaporator and a refrigerant outlet of the pressure reducing device is shorter than a linear distance between a refrigerant outlet of the evaporator and the refrigerant outlet of the pressure reducing device, the evaporator is a flat tube heat exchanger including a flat tube through which refrigerant passes, and a fin attached to the flat tube, and the refrigerant inlet of the evaporator is an end portion of a refrigerant inlet of the flat tube, and the refrigerant outlet of the evaporator is an end portion of a refrigerant outlet of the flat tube.

11. A refrigeration cycle apparatus comprising a refrigerant circuit including a compressor, a condenser, a pressure reducing device, and an evaporator connected by a refrigerant pipe, a refrigerant including a refrigerant having flammability being used as refrigerant circulating in the refrigerant circuit, wherein the compressor, the condenser, and the pressure reducing device is accommodated in a unit, the condenser is disposed in the unit in such a manner that a linear distance between a refrigerant outlet of the condenser and a refrigerant inlet of the pressure reducing device is shorter than a linear distance between a refrigerant inlet of the condenser and the refrigerant inlet of the pressure reducing device, the condenser is a flat tube heat exchanger including a flat tube through which refrigerant passes, and a fin attached to the flat tube, the refrigerant inlet of the condenser is an end portion of a refrigerant inlet of the flat tube, and the refrigerant outlet of the condenser is an end portion of a refrigerant outlet of the flat tube.

* * * * *